US008960326B2

(12) United States Patent
Williams

(10) Patent No.: US 8,960,326 B2
(45) **Date of Patent: *Feb. 24, 2015**

(54) FORMATION DIP GEO-STEERING METHOD

(71) Applicant: Danny T. Williams, Katy, TX (US)

(72) Inventor: Danny T. Williams, Katy, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/488,079

(22) Filed: Sep. 16, 2014

(65) Prior Publication Data

US 2015/0000980 A1 Jan. 1, 2015

Related U.S. Application Data

(63) Continuation-in-part of application No. 13/660,298, filed on Oct. 25, 2012, now Pat. No. 8,875,806, which is a continuation-in-part of application No. 13/568,269, filed on Aug. 7, 2012, now abandoned, which is a continuation of application No. 13/347,677, filed on Jan. 10, 2012, now abandoned, which is a continuation of application No. 13/154,508, filed on Jun. 7, 2011, now abandoned, which is a continuation of application No. 12/908,966, filed on Oct. 21, 2010, now abandoned, which is a continuation of application No. 12/431,339, filed on Apr. 28, 2009, now abandoned, which is a continuation of application No. 11/705,990, filed on Feb. 14, 2007, now Pat. No. 7,546,209, which is a continuation of application No. 10/975,966, filed on Oct. 28, 2004, now Pat. No. 7,191,850.

(51) Int. Cl.

| | |
|---|---|
| ***E21B 7/02*** | (2006.01) |
| ***E21B 47/02*** | (2006.01) |
| ***E21B 47/09*** | (2012.01) |
| ***E21B 7/04*** | (2006.01) |

(52) U.S. Cl.
CPC .. *E21B 47/09* (2013.01); *E21B 7/04* (2013.01)
USPC ..... 175/24; 175/45; 702/7

(58) Field of Classification Search
USPC ..... 175/24, 45; 702/6, 7, 9
See application file for complete search history.

(56) References Cited

U.S. PATENT DOCUMENTS

| | | | |
|---|---|---|---|
| 514,170 | A | 2/1894 | Tesla |
| 2,176,169 | A | 10/1939 | Georges |

(Continued)

FOREIGN PATENT DOCUMENTS

| | | | |
|---|---|---|---|
| EP | 0015137 | A1 | 9/1980 |
| WO | 2011146079 | A1 | 11/2011 |

*Primary Examiner* — William P Neuder
(74) *Attorney, Agent, or Firm* — Buskop Law Group, PC; Wendy Buskop

(57) ABSTRACT

A geo-steering method for drilling a formation penetrated by multiple wells. The method comprises computing a stratigraphic target formation window, computing a target line utilizing an instantaneous formation dip angle correlated to offset well data from an offset well. The method further comprises calculating a target window from actual drilling data overlaying the target window over the stratigraphic target formation window to drill on the target line, identifying target deviation from target line using overlaid windows, generating a target deviation flag when the overlaid results differ above or below the stratigraphic target formation window or user inputted target deviation flag parameters, wherein the target deviation flag stops drilling by the rig. The method performs another actual survey, creating a new window, starting drilling, creating a new target window, overlaying the two windows and monitoring for target deviations, repeating the process until target depth is reached.

7 Claims, 18 Drawing Sheets

(56) References Cited

U.S. PATENT DOCUMENTS

| | | | | |
|---|---|---|---|---|
| 2,586,939 | A | 2/1952 | Grable | |
| 2,658,284 | A | 11/1953 | Jacobs | |
| 3,437,169 | A | 4/1969 | Youmans | |
| 3,823,787 | A | 7/1974 | Haworth et al. | |
| 4,386,664 | A | 6/1983 | Miller | |
| 5,237,539 | A | 8/1993 | Selman | |
| 5,311,951 | A | 5/1994 | Kyte et al. | |
| 5,678,643 | A | 10/1997 | Robbins et al. | |
| 5,812,068 | A | 9/1998 | Wisler et al. | |
| 5,821,414 | A | 10/1998 | Noy et al. | |
| 6,272,434 | B1 | 8/2001 | Wisler et al. | |
| 6,556,016 | B2 | 4/2003 | Gao et al. | |
| 6,631,563 | B2 | 10/2003 | Brosnahan et al. | |
| 6,643,589 | B2 | 11/2003 | Zhang et al. | |
| 6,760,665 | B1 | 7/2004 | Francis | |
| 6,819,111 | B2 | 11/2004 | Fanini et al. | |
| 6,877,241 | B2 | 4/2005 | Barr et al. | |
| 6,885,947 | B2 | 4/2005 | Xiao et al. | |
| 7,188,685 | B2 | 3/2007 | Downton et al. | |
| 7,191,850 | B2 | 3/2007 | Williams | |
| 7,546,209 | B2 | 6/2009 | Williams | |
| 7,689,969 | B1 * | 3/2010 | Wendling | 717/105 |
| 8,042,616 | B2 | 10/2011 | Giroux et al. | |
| 8,061,442 | B2 | 11/2011 | Alberty | |
| 8,463,549 | B1 | 6/2013 | Selman et al. | |
| 8,463,550 | B1 | 6/2013 | Selman et al. | |
| 8,875,806 | B2 * | 11/2014 | Williams | 175/24 |
| 2003/0037963 | A1 | 2/2003 | Barr et al. | |
| 2003/0056381 | A1 | 3/2003 | Brosnahan et al. | |
| 2003/0121702 | A1 | 7/2003 | Downton et al. | |
| 2003/0127252 | A1 | 7/2003 | Downton et al. | |
| 2006/0090934 | A1 | 5/2006 | Williams | |
| 2007/0205020 | A1 | 9/2007 | Williams | |
| 2009/0132458 | A1 * | 5/2009 | Edwards et al. | 706/50 |
| 2009/0260881 | A1 | 10/2009 | Williams | |
| 2011/0031019 | A1 | 2/2011 | Williams | |
| 2011/0232967 | A1 | 9/2011 | Williams | |

* cited by examiner

Dip Calculation:

Inverse Tangent ({top of target in 16- top of target in 8} / distance between wells) = Dip in deg.

Example: Inverse Tangent ({2200' - 2280'} / 5000') = -0.9167 deg.

*Negative sign indicates down dip and positive sign indicates up dip.

| I | | II | | | III |
|---|---|---|---|---|---|
| OFFSET WELL | | TVD | MD | GR | VERTICAL DRIFT |
| 1010' | 106 | 1010.0 | 1010.0 | 100 | 100' |
| 1012' | 110 | 1015.0 | 1316.0 | 10 | 300' |
| 1012' | 112 | 1020.0 | 1822.0 | 10 | 800' |

| I | | II | | | III |
|---|---|---|---|---|---|
| OFFSET WELL | | TVD | MD | GR | VERTICAL DRIFT |
| 1009' | 114 | 1021.0 | 2225.0 | 40 | 1200' |
| 1010' | 116 | 1023.0 | 2327.0 | 10 | 1300' |
| 1015' | 118 | 1025.0 | 2530.0 | 90 | 1500' |

| I | | II | | | III |
|---|---|---|---|---|---|
| OFFSET WELL | | TVD | TD | GR | VERTICAL DRIFT |
| 1013.5' | 120 | 1024 | 2635.0 | 65 | 1575' |
| 1013.0' | 122 | 1026.5 | 3136.0 | 35 | 2035' |
| 1012.5' | 124 | 1027 | 3337.0 | 20 | 2175' |

| Svy | Depth | Inc | Azm | TVD | VS | DL | TPOS | TL | DIP | FAULT |
|---|---|---|---|---|---|---|---|---|---|---|
| 103 | 9562.00 | 90.40 | 117.20 | 5836.11 | 4009.98 | 1.53 | -8.34 | 5827.77 | -1.20 | 0.00 |
| BPrj | 9608.00 | 90.40 | 117.20 | 5835.79 | 4055.92 | 0.00 | -7.80 | 5828.19 | -0.53 | 0.00 |
| PA1 | 10052.29 | 90.45 | 120.00 | 5832.30 | 4500.00 | 0.63 | 0.00 | 5832.30 | -0.53 | 0.00 |
| PA2 | 10552.34 | 89.47 | 120.00 | 5836.92 | 5000.00 | 0.39 | 0.00 | 5836.92 | -0.53 | 0.00 |
| PA3 | 11052.36 | 89.47 | 120.00 | 5841.55 | 5500.00 | 0.00 | 0.00 | 5841.55 | -0.53 | 0.00 |
| PA4 | 11552.38 | 89.47 | 120.00 | 5846.18 | 6000.00 | 0.00 | 0.00 | 5846.18 | -0.53 | 0.00 |
| PA5 | 12052.41 | 89.47 | 120.00 | 5850.80 | 6500.00 | 0.00 | 0.00 | 5850.80 | -0.53 | 0.00 |

| | | | | | | | | | | | |
|---|---|---|---|---|---|---|---|---|---|---|---|
| 102 | 9467 | 91.80 | 117.60 | 5837.93 | 3915.10 | 1.20 | -12.15 | 5825.78 | -1.20 | | A |
| Svy | Depth | Inc | Azm | TVD | VS | DL | TPOS | TL | DIP | FAULT | B |
| 103 | 9562.00 | 90.40 | 117.20 | 5836.11 | 4009.98 | 1.53 | -8.34 | 5827.77 | -1.20 | 0.00 | C |
| BPrj | 9608.00 | 90.40 | 117.20 | 5835.79 | 4055.92 | 0.00 | -7.60 | 5828.19 | -0.53 | 0.00 | |
| PA1 | 10052.29 | 90.45 | 120.00 | 5832.30 | 4500.00 | 0.63 | 0.00 | 5832.30 | -0.53 | 0.00 | |
| PA2 | 10552.34 | 89.47 | 120.00 | 5836.92 | 5000.00 | 0.39 | 0.00 | 5836.92 | -0.53 | 0.00 | |
| PA3 | 11052.36 | 89.47 | 120.00 | 5841.55 | 5500.00 | 0.00 | 0.00 | 5841.55 | -0.53 | 0.00 | |
| PA4 | 11552.38 | 89.47 | 120.00 | 5846.18 | 6000.00 | 0.00 | 0.00 | 5846.18 | -0.53 | 0.00 | |
| PA5 | 12052.41 | 89.47 | 120.00 | 5850.80 | 6500.00 | 0.00 | 0.00 | 5850.80 | -0.53 | 0.00 | |
FIG. 12A
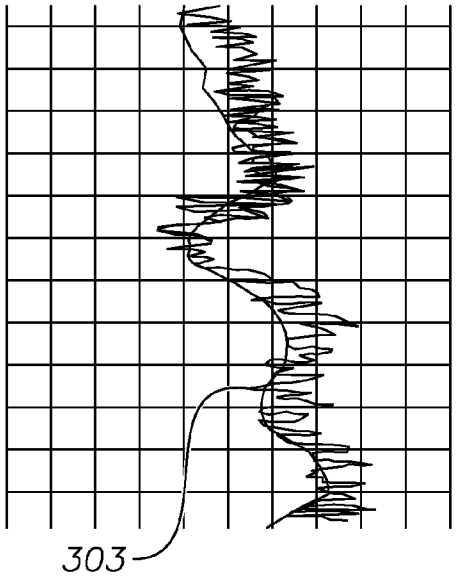
FIG. 12C
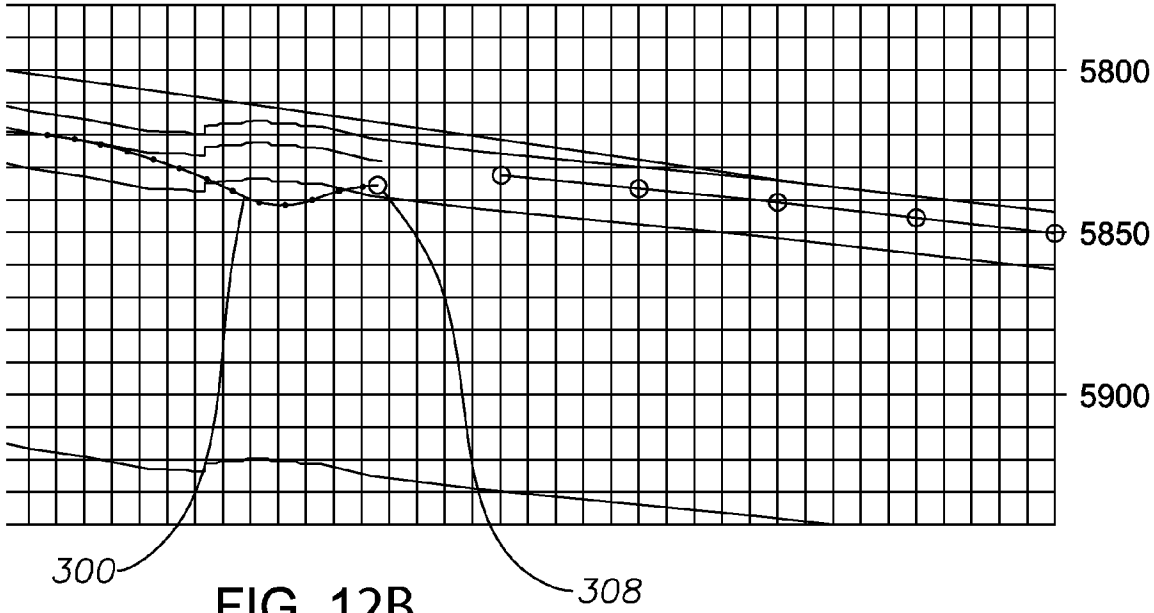
FIG. 12B

| Sw | Depth | Inc | Azm | TVD | VS | DL | TPOS | TL | DIP | FAULT |
|---|---|---|---|---|---|---|---|---|---|---|
| 104 | 9658.00 | 90.90 | 116.80 | 5835.02 | 4106.83 | 0.67 | -8.59 | 5828.44 | -0.40 | 0.00 |
| BPrj | 9704.00 | 90.90 | 116.80 | 5834.30 | 4151.75 | 0.00 | -5.44 | 5828.86 | -0.53 | 0.00 |
| PA1 | 10052.46 | 90.36 | 120.00 | 5832.08 | 4500.00 | 0.97 | 0.00 | 5832.08 | -0.53 | 0.00 |
| PA2 | 10552.50 | 89.47 | 120.00 | 5836.71 | 5000.00 | 0.36 | 0.00 | 5836.71 | -0.53 | 0.00 |
| PA3 | 11052.53 | 89.47 | 120.00 | 5841.33 | 5500.00 | 0.00 | 0.00 | 5841.33 | -0.53 | 0.00 |
| PA4 | 11052.55 | 89.47 | 120.00 | 5845.96 | 6000.00 | 0.00 | 0.00 | 5845.96 | -0.53 | 0.00 |
| PA5 | 12052.57 | 89.47 | 120.00 | 5850.58 | 6500.00 | 0.00 | 0.00 | 5950.58 | -0.53 | 0.00 |

FIG. 14

| Sw | Depth | Inc | Azm | TVD | VS | DL | TPOS | TL | DIP | FAULT |
|---|---|---|---|---|---|---|---|---|---|---|
| 104 | 9658.00 | 90.90 | 116.80 | 5835.02 | 4105.83 | 0.67 | -4.08 | 5830.95 | -1.90 | 0.00 |
| BPrj | 9704.00 | 90.90 | 116.80 | 5834.30 | 4151.75 | 0.00 | -2.93 | 5831.37 | -0.53 | 0.00 |
| PA1 | 10052.46 | 89.95 | 120.00 | 5834.59 | 4500.00 | 1.07 | 0.00 | 5834.59 | -0.53 | 0.00 |
| PA2 | 10552.49 | 89.47 | 120.00 | 5839.22 | 5000.00 | 0.19 | 0.00 | 5839.22 | -0.53 | 0.00 |
| PA3 | 11052.52 | 89.47 | 120.00 | 5843.84 | 5500.00 | 0.00 | 0.00 | 5843.84 | -0.53 | 0.00 |
| PA4 | 11552.54 | 89.47 | 120.00 | 5848.47 | 6000.00 | 0.00 | 0.00 | 5848.47 | -0.53 | 0.00 |
| PA5 | 12052.56 | 89.47 | 120.00 | 5853.09 | 6500.00 | 0.00 | 0.00 | 5853.09 | -0.53 | 0.00 |

FIG. 16

FORMATION DIP GEO-STEERING METHOD

CROSS REFERENCE TO RELATED APPLICATIONS

The present application is a Continuation in Part of and claims priority to U.S. patent application Ser. No. 13/660,298 filed on Oct. 25, 2012, which is a continuation-in-part of U.S. patent application Ser. No. 13/568,269 filed on Aug. 7, 2012, which is a continuation of U.S. patent application Ser. No. 13/347,677, filed on Jan. 10, 2012, which is a continuation of U.S. patent application Ser. No. 13/154,508, filed on Jun. 7, 2011, which is a continuation of U.S. patent application Ser. No. 12/908,966, filed on Oct. 21, 2010, which is a continuation of U.S. patent application Ser. No. 12/431,339, filed on Apr. 28, 2009, which is a continuation of U.S. patent application Ser. No. 11/705,990, filed on Feb. 14, 2007, which issued as U.S. Pat. No. 7,546,209 on Jun. 9, 2009, which is a continuation of U.S. patent application Ser. No. 10/975,966, filed on Oct. 28, 2004, which issued as U.S. Pat. No. 7,191,850 on Mar. 20, 2007, all of which are entitled "FORMATION DIP GEO-STEERING METHOD." These references are hereby incorporated in their entirety.

FIELD

The present embodiments relate to methods of steering a drill bit, and more specifically, but not by way of limitation, to methods of geo-steering a bit while drilling directional and horizontal wells.

BACKGROUND

In the exploration, drilling, and production of hydrocarbons, it becomes necessary to drill directional and horizontal wells. As those of ordinary skill in the art appreciate, directional and horizontal wells can increase the production rates of reservoirs. Hence, the industry has seen a significant increase in the number of directional and horizontal wells drilled. Additionally, as the search for hydrocarbons continues, operators have increasingly been targeting thin beds and/or seams with high to very low permeability. The industry has also been targeting unconventional hydrocarbon reservoirs such as tight sands, shales, and coal.

Traditionally, these thin bed reservoirs, coal seams, shales and sands may range from less than five feet to twenty feet. In the drilling of these thin zones, operators attempt to steer the drill bit within these zones. As those of ordinary skill in the art will recognize, keeping the wellbore within the zone is highly desirable for several reasons including, but not limited to, maintaining greater drilling rates, maximizing production rates once completed, limiting water production, preventing wellbore stability problems, exposing more productive zones, etc.

Various prior art techniques have been introduced. However, all these techniques suffer from several problems. For instance, in the oil and gas industry, it has always been an accepted technique to gather surface and subsurface information and then map or plot the information to give a better understanding of what is actually happening below the earth's surface. Some of the most common mapping techniques used today includes elevation contour maps, formation contour maps, sub-sea contour maps and formation thickness (isopac) maps. Some or most of these can be presented together on one map or separate maps. For the most part, the information that is gathered to produce these maps are from electric logging and real time measurement while drilling and logging devices (gamma ray, resistivity, density neutron, sonic or acoustic, surface and subsurface seismic or any available electric log). This type of data is generally gathered after a well is drilled. Additionally, measurement while drilling and logging while drilling techniques allow the driller real time access to subterranean data such as gamma ray, resistivity, density neutron, and sonic or acoustic and subsurface seismic. This type of data is generally gathered during the drilling of a well.

These logging techniques have been available and used by the industry for many years. However, there is a need for a technique that will utilize historical well data and real time downhole data to steer the bit through the zone of interest. There is a need for a method that will produce, in real time during drilling, an instantaneous dip for a very thin target zone. There is also a need for a process that will utilize the instantaneous dip to produce a calculated target window (top and bottom) and extrapolate this window ahead of the projected well path so an operator can keep the drill bit within the target zone identified by the calculated dip and associated calculated target window.

In the normal course of drilling, it is necessary to perform a survey. As those of ordinary skill in the art will appreciate, in order to guide a wellbore to a desired target, the position and direction of the wellbore at any particular depth must be known. Since the early days of drilling, various tools have been developed to measure the inclination and azimuth of the wellbore.

In order to calculate the three dimensional path of the wellbore, it is necessary to take measurements along the wellbore at known depths of the inclination (angle from vertical) and azimuth (direction normally relative to true north). These measurements are called surveys.

Prior art survey tools include those run on wireline such as but not limited to steering tools as well as those associated with measurement while drilling (MWD), electro-magnetic measurement while drilling (EM-MWD) and magnetic single shot (MSS). Hence, after drilling a hole section, a wireline survey is run inside the drill pipe before pulling out with the drill bit, or by running a wireline survey inside the steel casing once it is cemented in place. During drilling, many government regulations require the running of a wireline survey or getting an MWD survey, or EM-MWD survey, such as in some cases every 200 feet for horizontal wells and every 500 feet for deviated wells.

In today's environment of drilling and steering in ultra-thin target zones, knowing the true stratigraphic position and direction of the bit within the true stratigraphic formation is critical. Operators need to know the accurate position of the bit and bit projection path. In the event of an actual deviation from a planned stratigraphic wellbore projection path, time is critical in order to correct the bit direction back to the planned true stratigraphic path to prevent the bit from drilling into nonproductive zones.

BRIEF DESCRIPTION OF THE DRAWINGS

The detailed description will be better understood in conjunction with the accompanying drawings as follows:

FIG. 12A depicts a larger version of the chart of the starting window data from FIG. 11.

FIG. 12B depicts a detailed view of the wellbore plot showing the target line and starting stratigraphic window from FIG. 11.

FIG. 12C depicts a detail of modeled log data against offset well data from FIG. 11.

FIG. 14 depicts a larger version of the chart from FIG. 13.

FIG. 16 a larger version of the chart depicted in FIG. 15A.

Figure 1:
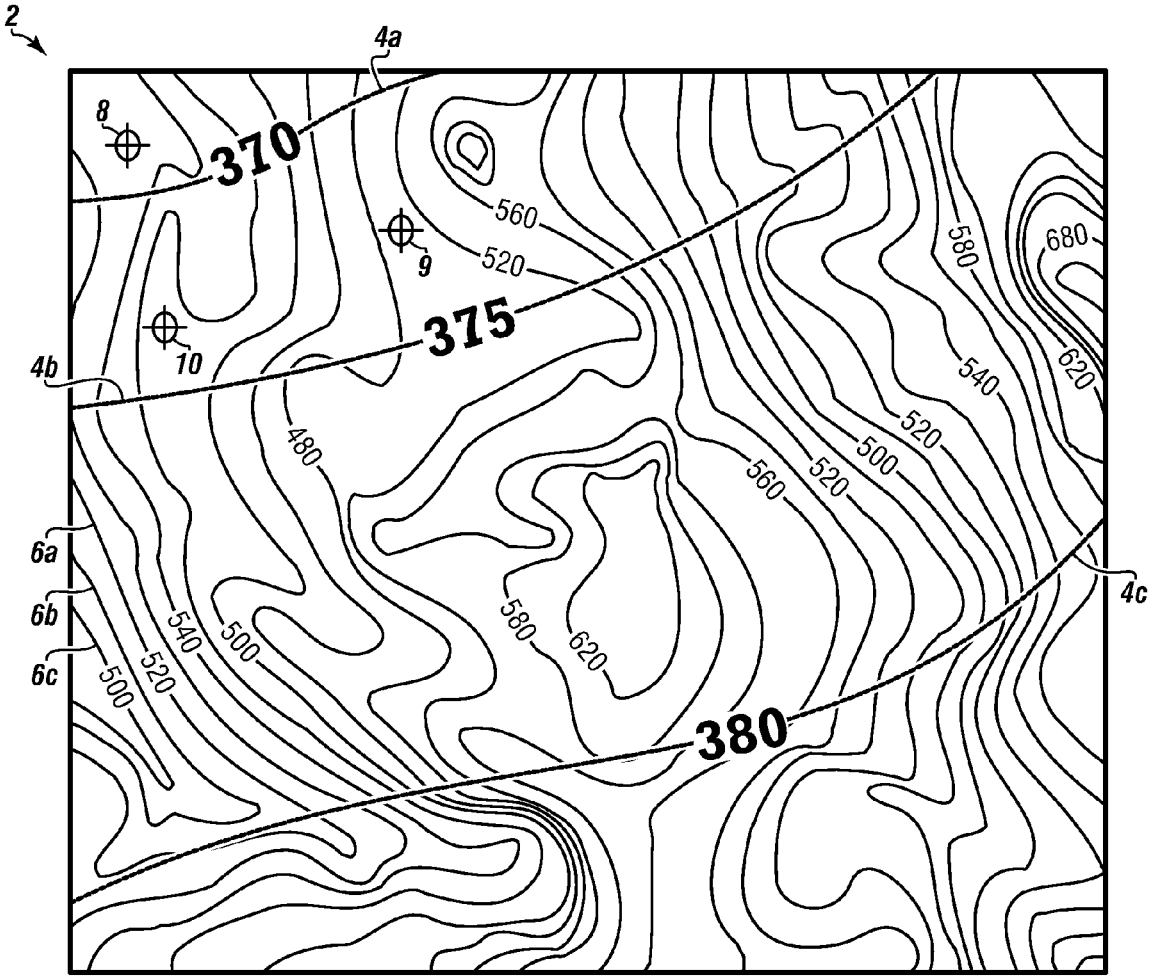
FIG. 1 is a surface elevation and formation of interest contour map with offset well locations.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

A method of drilling a well is disclosed. The method includes selecting a target subterranean reservoir and estimating the formation depth of the target reservoir. The method further includes calculating an estimated formation dip angle of the target reservoir based on data selected from the group consisting of: offset well data, seismic data, core data, and pressure data. Then, the top of the target reservoir is calculated and then the bottom of the target reservoir is calculated so that a target window is established.

The method involves a geo-steering method using actual survey data, formatting survey data into WITS, WITSML and LAS formats and computing a stratigraphic target formation window; computing a target line utilizing an instantaneous formation dip angle (ifdip) correlated to offset well data from an offset well; calculating a target window from actual drilling data overlaying the target window over the stratigraphic target formation window to drill on the target line; identifying target deviation from target line using overlaid windows; generating a target deviation flag when the overlaid results differs within +/−2TVD to +/−4TVD above or below the stratigraphic target formation window or user input target deviation flag parameters; wherein the target deviation flag stops drilling by the rig, then performing another actual survey, creating a new window, starting drilling, creating a new target window, overlaying the two windows and monitoring for target deviations, repeating the process until target depth is reached.

The method includes projecting the target window ahead of the intended path and drilling the well. Next, the target reservoir is intersected. The target formation is logged with a measurement while drilling means and data representative of the characteristics of the reservoir is obtained with the measurement while drilling means selected from the group consisting of, but not limited to: gamma ray, density neutron, sonic or acoustic, subsurface seismic and resistivity. The method further includes, at the target reservoir's intersection, revising the top of the target reservoir and revising the bottom of the target reservoir to properly represent their position in relationship to the true stratigraphic position (TSP) of the drill bit, through dip manipulation to match the real time log data to correlate with the offset data, and thereafter, projecting a revised target window.

The method further comprises correcting the top of the target reservoir and the bottom of the target reservoir through dip manipulation to match the real time logging data to the correlation offset data to directionally steer the true stratigraphic position of the drill bit and stay within the new calculated target window while drilling ahead. In one embodiment, the step of correcting the top and bottom of the target reservoir includes adjusting an instantaneous formation dip angle (ifdip) based on the real time logging and drilling data's correlation to the offset data in relationship to the TSP of the drill bit so that the target window is adjusted (for instance up or down, wider or narrower), to reflect the target window's real position as it relates to the TSP of the drill bit. The method may further comprise drilling and completing the well for production.

In one embodiment, the estimated formation dip angle is obtained by utilizing offset well data that includes offset well data such as electric line logs, seismic data, core data, and pressure data. In one or more embodiments, the representative logging data obtained includes a gamma ray log.

In embodiments, a method of drilling a well with a bit within a target subterranean reservoir is disclosed. The method comprises modeling and calculating an estimated formation dip angle, drilling the well with a logging while drilling measurement tool (LWD) and obtaining real time data representative of the characteristics of the reservoir. The method further includes collecting information from any rig surface monitoring equipment data and the LWD tool at the well surface location, transmitting this information to a remote control unit, modeling and calculating a target line that creates a top and bottom of the formation utilizing an instantaneous formation dip angle (ifdip), and wherein the ifdip is calculated based on the real time representative data correlated to an offset well data generated from an offset well. The method includes plotting and evaluating the rig surface equipment monitoring data with the LWD interpreted data. Next, a target window is projected for drilling the well. The method further comprises projecting a target window deviation, generating a target window deviation flag, transmitting the target window deviation flag to the well surface location, and ceasing the drilling of the well to perform a well survey. The method further comprises, after a deviation flag evaluation process, sending detailed drilling instructions pertaining to drilling distance required and orientation of the downhole drilling equipment during a well path correction resulting from the deviation flag evaluation process.

The method may further include drilling the well with the LWD tool and obtaining real time data representative of the characteristics of the reservoir, collecting real time information from the LWD tool at the well surface, and transmitting the real time information to the remote control unit. Next, the method comprises modeling and calculating a revised target line that creates a top and bottom of the formation utilizing the ifdip and plotting and evaluating the rig surface equipment monitoring data with the LWD ifdip interpreted data, then projecting a second target window for drilling the well. As per the teachings of this disclosure, the method may also include projecting a second real time target window deviation from the revised target line, transmitting a second target window deviation flag to the well surface location and ceasing the drilling to perform a second well survey.

In another embodiment, a method of drilling a subterranean well from a surface location is disclosed. The method comprises estimating a target formation depth and a target formation dip angle, calculating a target line that creates a top and bottom of the target formation that forms a first projection window, and drilling within the first projection window. The method also includes transmitting information from the subterranean well, projecting a target deviation, ceasing the drilling of the well, and performing a well survey so that well survey information is generated. The method can also include estimating a formation dip angle with the well survey information, calculating a revised target line that creates a revised top and bottom of the target formation that forms a second projection window, drilling within the second projection window, and transmitting information from the subterranean well. As per the teachings of this disclosure, the method may also comprise projecting a second target deviation using a revised target line, ceasing the drilling of the well, and performing a second well survey so that well survey information is generated.

An advantage of the present embodiments includes use of logs from offset wells such as gamma ray, resistivity, density neutron, sonic or acoustic, and surface and subsurface seismic. Another advantage is that the present embodiments will use data from these logs and other surface and downhole data to calculate a dip for a very thin target zone. Yet another advantage is that during actual drilling, the method herein disclosed will produce a target window (top and bottom) and extrapolate this window ahead of the projected well path so an operator can keep the drill bit within the target zone identified by the ifdip and target window.

A feature of the present embodiments is that the method uses real time drilling and logging data and historical data to recalculate the instantaneous dip of the target window as to its correlation of the real time logging data versus the offset wells data in relationship to the TSP of the drill bit within the target window. Another feature is that the method will then produce a new target window (top and bottom) and wherein this new window is extrapolated outward. Yet another feature is that this new window will be revised based on actual data acquired during drilling such as, but not limited to, the real time gamma ray indicating bed boundaries. Yet another feature is that the projection window is controlled by the top of the formation of interest as well as the bottom of the formation of interest. In other words, a new window will be extrapolated based on real time information adjusting the top and/or bottom of the formation of interest as it relates to the TSP of the drill bit within that window, through the correlation of the real time logging and drilling data to the offset well data.

Referring now to FIG. 1, a surface elevation with formation of interest contour map 2 with offset well locations will now be described. As seen in FIG. 1, the subsurface top of target formation of interest (FOI) contour lines (see generally 4*a*, 4*b*, 4*c*) is shown. Also shown in FIG. 1 are the surface elevation lines (see generally 6*a*, 6*b*, 6*c*). FIG. 1 also depicts the offset well locations 8, 9 and 10, and as seen on the map, these offset well locations contain the target formation window thickness as intersected by those offset wells.

As understood by those of ordinary skill in the art, map 2 is generated using a plurality of tools such as logs, production data, pressure buildup data, and core data from offset wells 8, 9 and 10. Geologist may also use data from more distant wells. Additionally, seismic data can be used in order to help in generating map 2.

Figure 2:
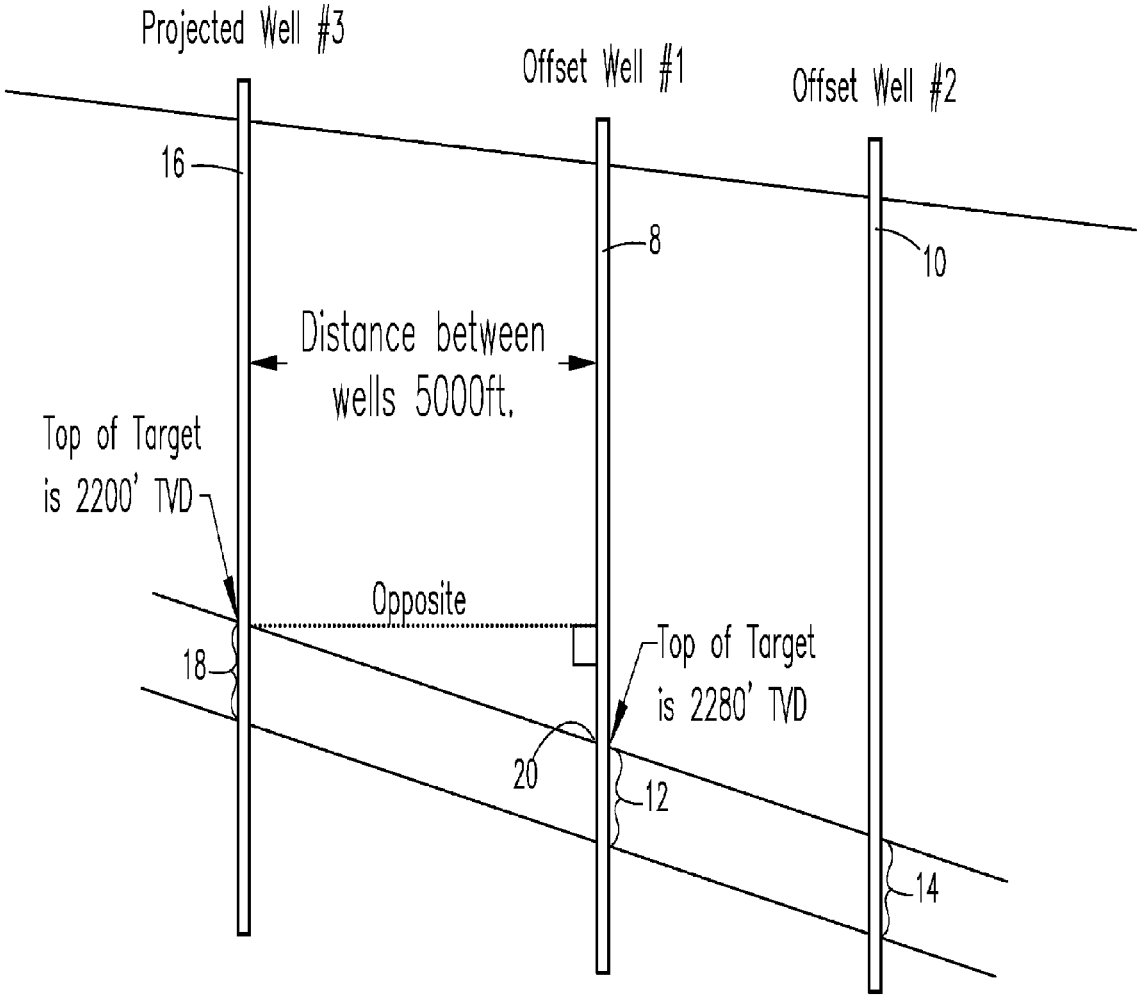
FIG. 2 is a partial cross-sectional geological view of two offset wells and a proposed well along with a dip calculation example.

Referring now to FIG. 2, a partial cross-sectional geological view of two offset wells 8, and 9 and a proposed well 16 is shown. More specifically, FIG. 2 depicts the offset well 8 and the offset well 10. The target formation of interest, which will be a subterranean reservoir in one embodiment, is identified in well 8 as 12, and in well 10 as 14. The formation of interest 18 is shown in an up dip orientation from offset wells 10 to 8 in relationship to the position of the proposed well 16.

The proposed well 16 is shown up dip relative to wells 8 and 10, and the formation of interest that would intersect the proposed wellbore is denoted as numeral 18. An operator may wish to drill the wellbore slightly above the formation of interest, or until the top of the target formation of interest, or through the formation of interest, and thereafter kick-off at or above the target formation of interest drilling a highly deviated horizontal wellbore to stay within the target formation of interest. FIG. 2 depicts wherein the formation dip angle can be readily ascertained. For instance, the angle at 20 is known by utilizing the geometric relationship well known in the art. For example, the operator may use the tangent relationship, wherein the tangent is equal to the opposite side divided by the adjacent side and the ratio is then converted to degrees; hence, the formation dip angle is easily calculated. It should be noted that other factors can be taken into account when calculating the formation dip angle as noted earlier. Data from seismic surveys can be used to modify the formation dip angle as readily understood by those of ordinary skill in the art.

In embodiments, the dip is calculated as follows: ([top of target in proposed well 16-top of target in offset well 8]/distance between wells).times.inverse tangent=dip in degrees.

Therefore, assuming that the top of the target in well 16 is 2200' TVD, the top of the target in well 8 is 2280', and the distance between the wells is 5000', the following calculation provides the dip angle:

([2200'-2280']/5000').times.inverse tangent=−0.9167 degrees{note: the negative sign indicates down dip and positive sign indicates up dip}

Figure 3A:
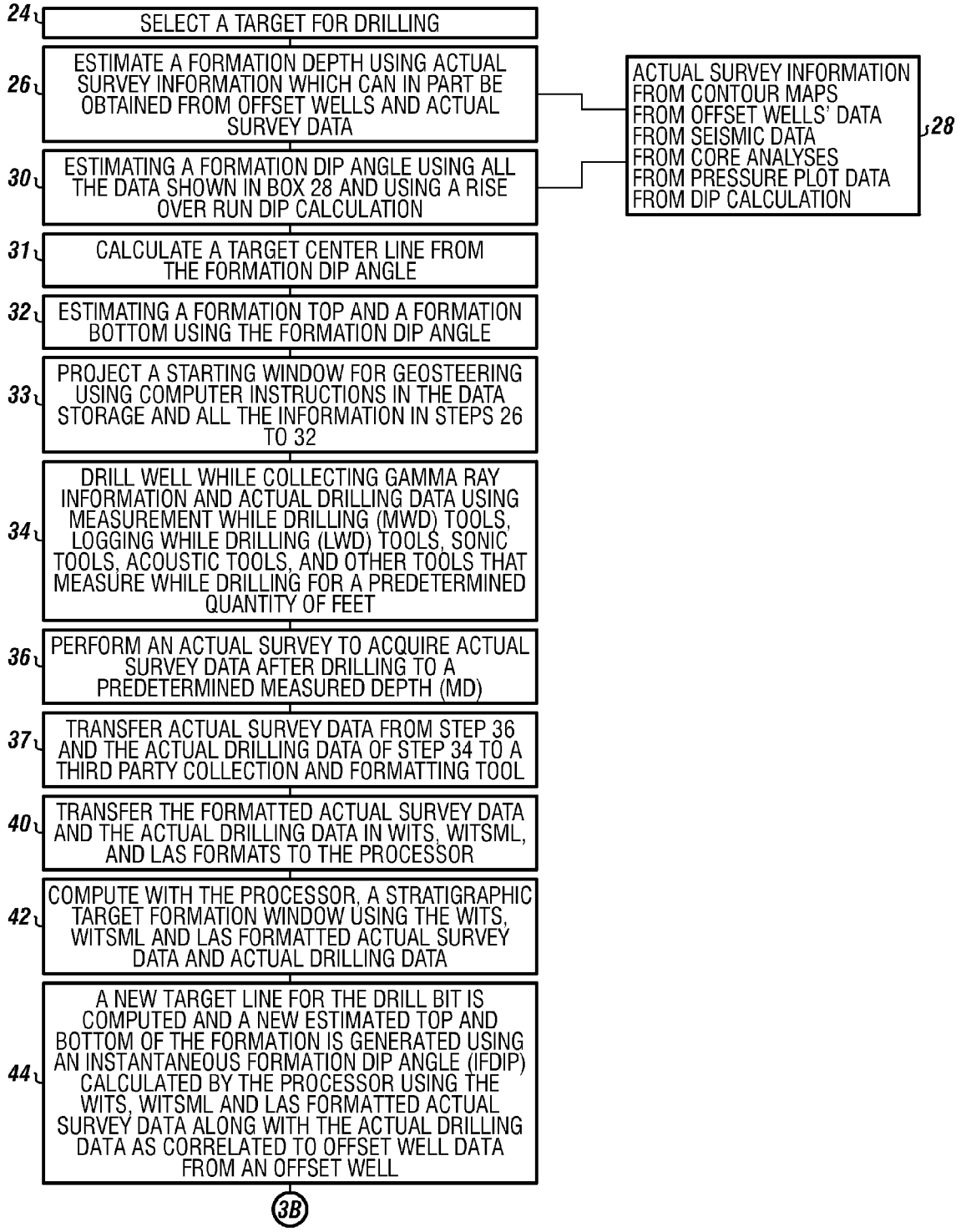
FIG. 3A is a flow chart of one embodiment of the method.
Figure 3B:
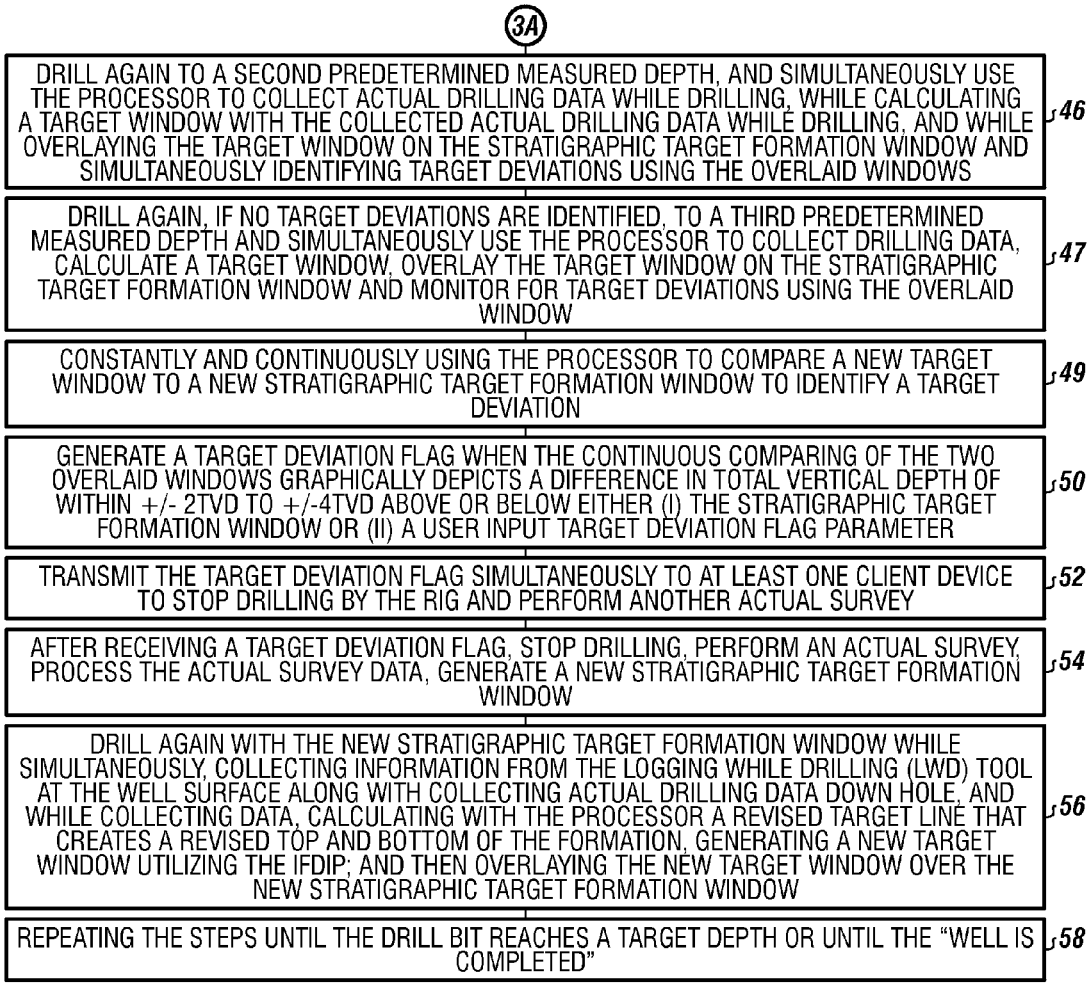
FIG. 3B is a continuation of FIG. 3A.

Referring now to FIGS. 3A and 3B, a flow chart of the method for drilling a formation penetrated by multiple wells, a bit moves through the formation.

The flow chart shows a first step of select a target for drilling (Step 24), such as by viewing a map shown in FIG. 1.

A formation depth is estimated using actual survey information which can in part be obtained from offset wells and actual survey data (Step 26). FIG. 2 shows that information can in part be obtained from offset wells as indicated in this step.

A formation dip angle is estimated using all the actual survey information 28 and using a rise over run dip calculation (Step 30). The actual survey information 28 is obtained from contour maps, from offset wells' data, from seismic data, from core analyses, from pressure plot data, and from dip calculation.

A target center line is calculated from the estimated formation dip angle (Step 31).

A formation top and a formation bottom are estimated using the estimated formation dip angle (Step 32).

A starting window for geo-steering is projected using computer instructions in the data storage and all the obtained in the previous information steps (Step 33).

The well is drilled and actual drilling data is collected using measurement while drilling (MWD) tools, logging while drilling (LWD) tools, sonic tools, acoustic tools, and other tools that measure while drilling for a predetermined quantity of feet (Step 34). Some of the data collected includes gamma ray data. Additionally, surface data can be accumulated while drilling.

Examples of the surface data collected while drilling include weight on bit, rate of penetration, differential pressure, mud pump pressure, background gas, and similar data.

An actual survey is performed to acquire actual survey data after drilling to a predetermined measured depth (MD) (Step 36). The predetermined measured depth (MD) can be the first 30 feet of a 100 foot wellbore.

The actual survey data and the actual drilling data are transferred to a third party collection and formatting tool (Step 37). The transfer can be done over the internet, over cellular and satellite networks, or combinations of these networks using the processor. The collection and formatting tool formats the data into WITS, WITSML and LAS formats.

The formatted actual survey data and the actual drilling data are then transferred to the processor using the network or combinations of networks (Step 40).

Figures 5A, 5B:
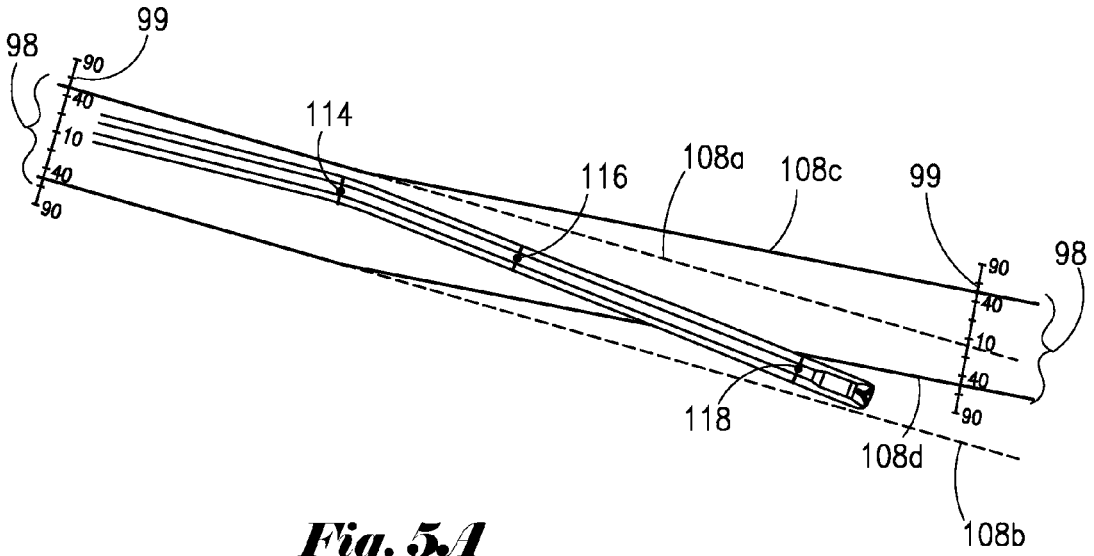
FIG. 5A is the schematic seen in FIG. 4A after further extended drilling.
FIG. 5B is a chart of gamma ray data obtained from the well seen in FIG. 5A.

A stratigraphic target formation window is computed using the WITS, WITSML and LAS formatted actual survey data and actual drilling data (Step 42). An exemplary stratigraphic target formation window is shown in FIG. 5A.

Figure 11:
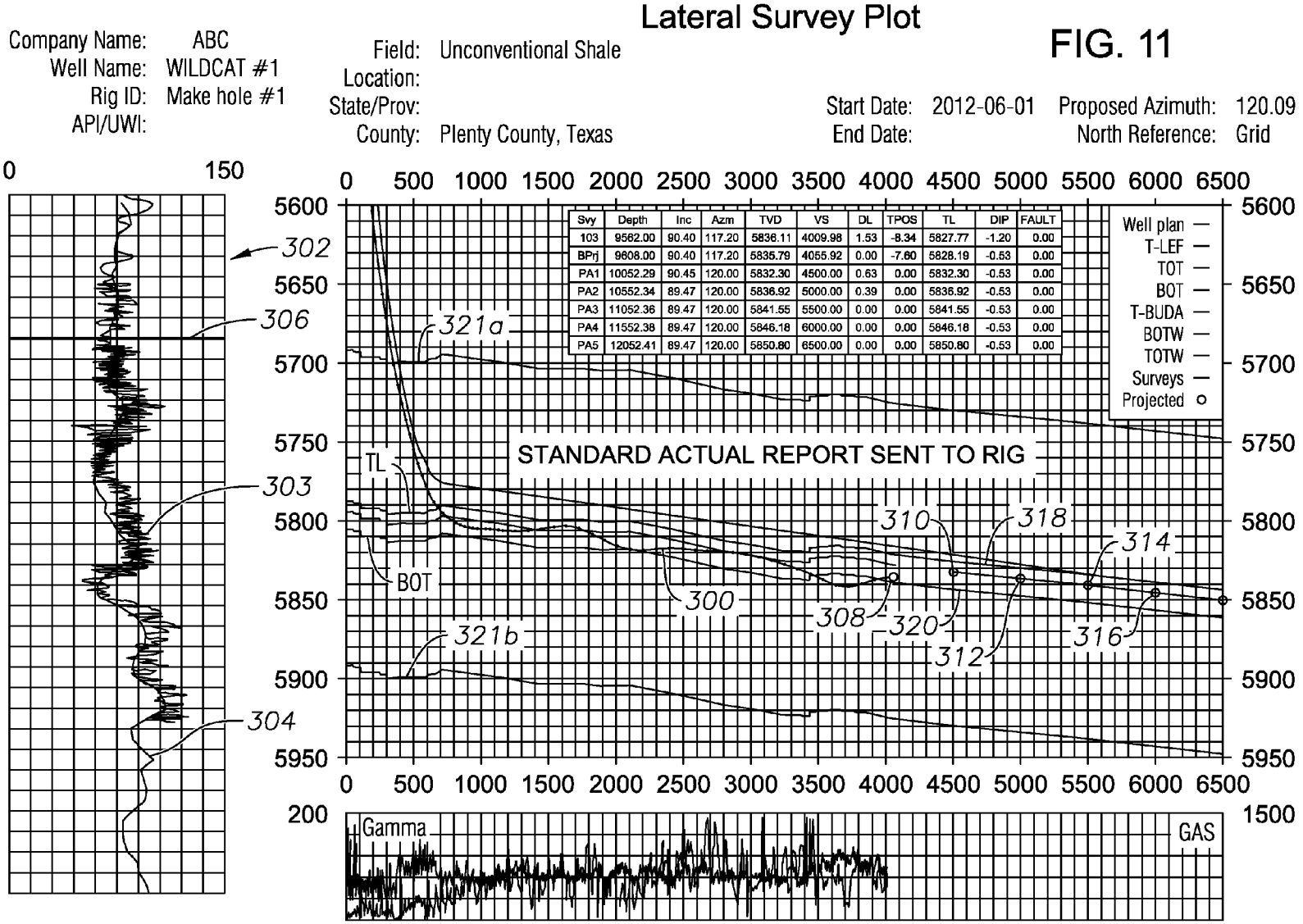
FIG. 11 depicts a wellbore plot with a target line and starting window calculated from data from contour maps, offset wells data, seismic data, core analyses data, pressure plot data and dip calculation using all data.

A new target line for the drill bit is computed and a new estimated top and bottom of the formation is generated using an instantaneous formation dip angle (ifdip) calculated by the processor using the WITS, WITSML and LAS formatted actual survey data along with the actual drilling data as correlated to offset well data from an offset well (Step 44). FIG. 11 shows a computed target line and a computed stratigraphic target formation window formed using the WITS, WITSML and LAS formatted actual survey data and the actual drilling data.

Continuing on to FIG. 3B, drilling occurs again to a second predetermined measured depth and, simultaneously, collect actual drilling data while drilling, while calculating a target window with the collected actual drilling data while drilling, and while overlaying the target window on the stratigraphic target formation window and simultaneously identifying target deviations using the overlaid windows (Step 46).

Figure 13:
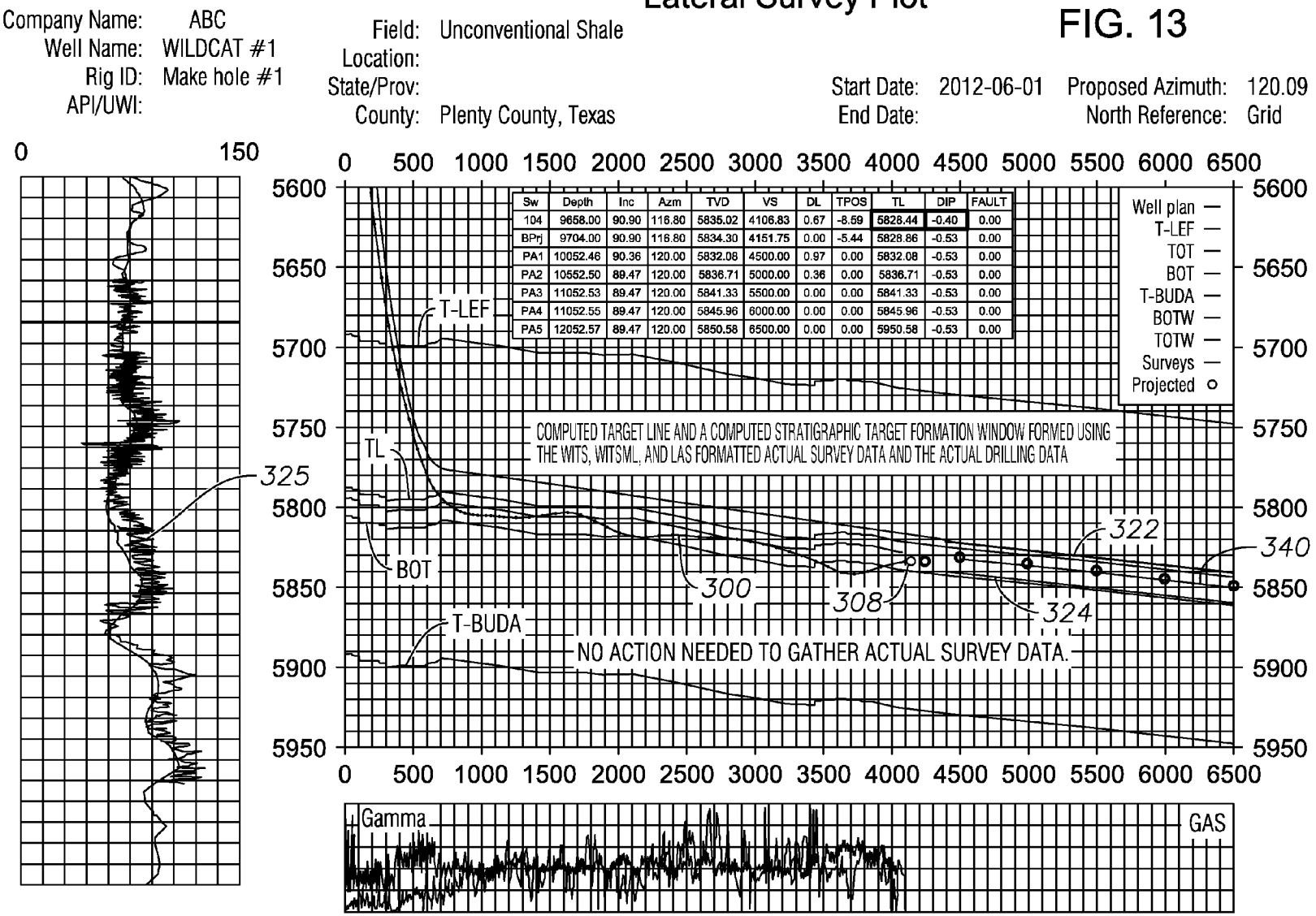
FIG. 13 depicts actual drilling data laid over the survey data target window.

FIG. 13 shows the stratigraphic target formation window from FIG. 11 with actual drilling data superimposed over the stratigraphic target window. FIG. 13 shows there is no target deviation and the drilling process can continue. This step contemplates that the drilling continues if there is no target deviation.

If no target deviations are identified, drilling occurs again to a third predetermined measured depth and, simultaneously, collect actual drilling data while drilling, calculate a target window, overlay the target window on the stratigraphic target formation window and monitor for target deviations using the overlaid window (Step 47).

Figure 15A:
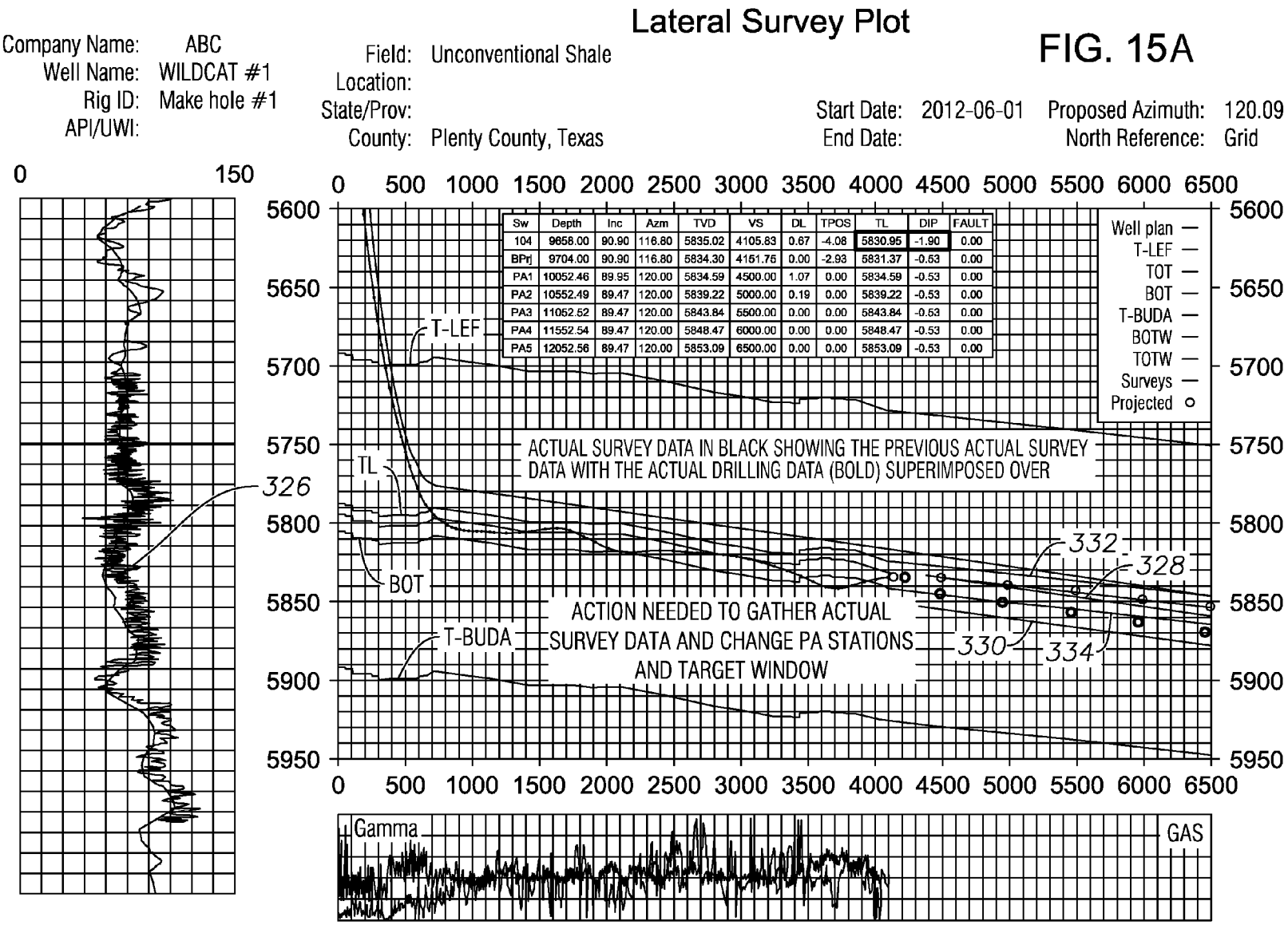
FIG. 15A depicts actual drilling data laid over the survey data target window with a target deviation.
Figure 15B:
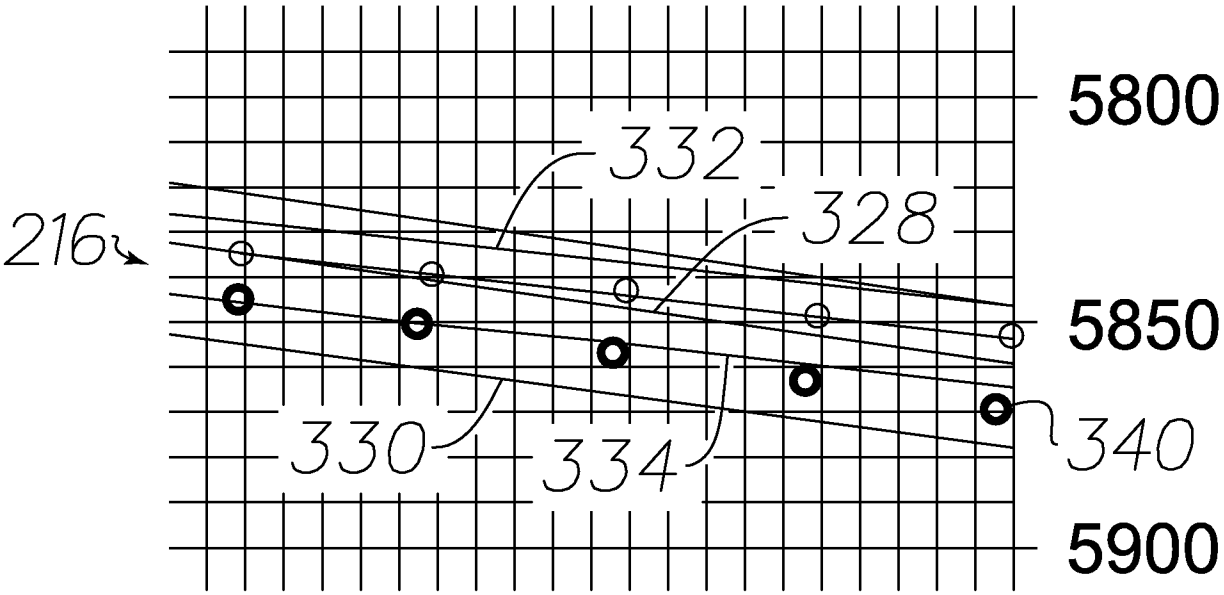
FIG. 15B depicts a detail of the target deviation which causes a target deviation flag to be generated.

FIGS. 15A and 15B shows an exemplary target window overlaid over a stratigraphic target formation window with a target deviation according to this step. In particular, FIGS. 15A and 15B shows the original stratigraphic target formation window top 332 and bottom 334 with the actual drilling data target window top 328 and window bottom 330 overlaid on top identifying a target deviation 216 in FIG. 15B.

Constantly and continuously, a new target window is compared to a new stratigraphic target formation window to identify a target deviation (Step 49).

FIG. 15B is a detail of the target deviation 216 showing the overlaid windows and the need for a target deviation flag.

A target deviation flag is generated when the continuous comparing of the two overlaid windows graphically depicts a difference in total vertical depth of within +/−2TVD to +/−4TVD above or below either (i) the stratigraphic target formation window or (ii) a user input target deviation flag parameter (Step 50).

The target deviation flag is generated simultaneously to at least one client device to stop drilling by the rig and perform another actual survey (Step 52).

Figure 8:
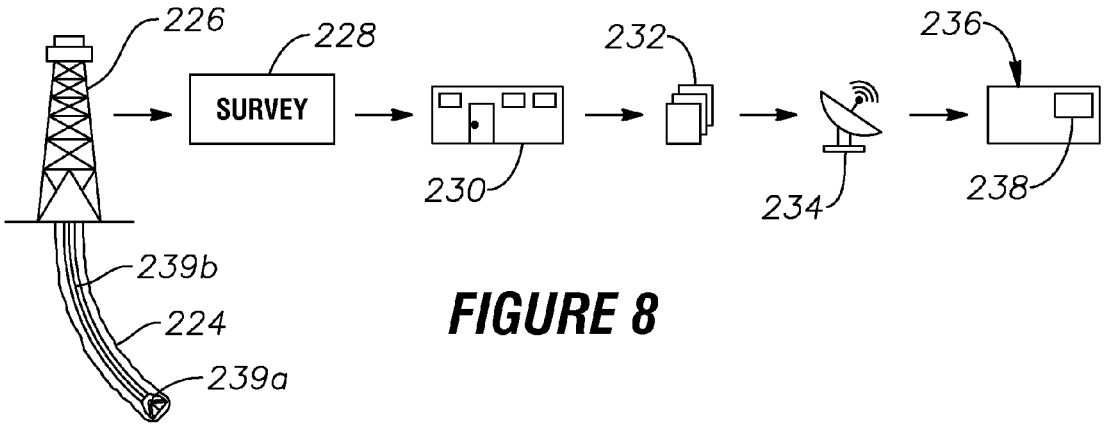
FIG. 8 portrays a schematic of the survey and geo-steering data flow process.
Figure 9:
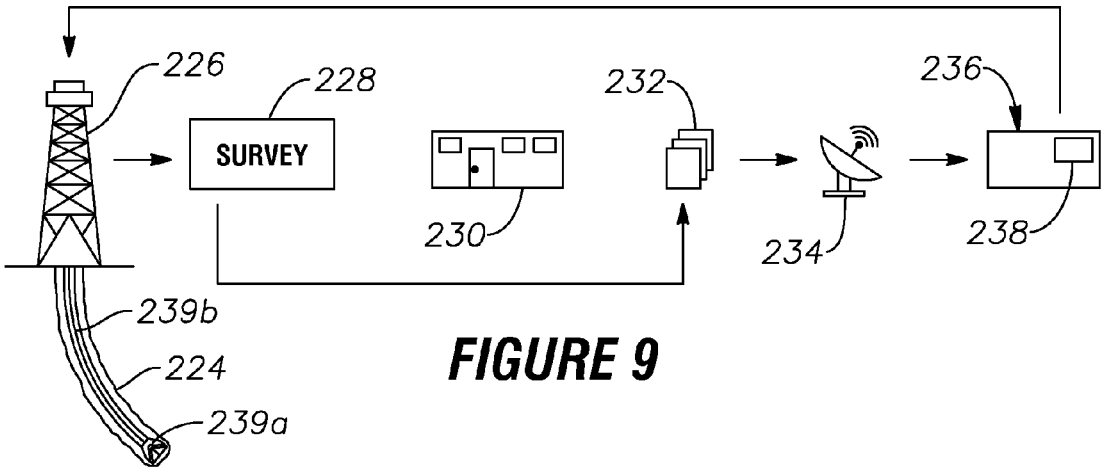
FIG. 9 depicts a schematic of another embodiment of the present data flow process.
Figure 10:
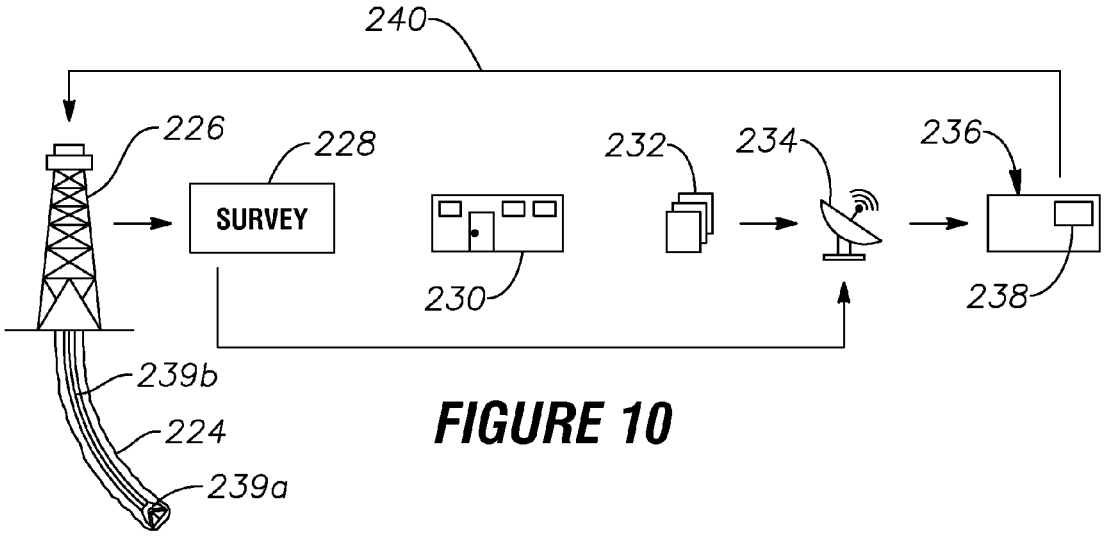
FIG. 10 depicts a schematic of still another embodiment of the present data flow process.
Figure 17:
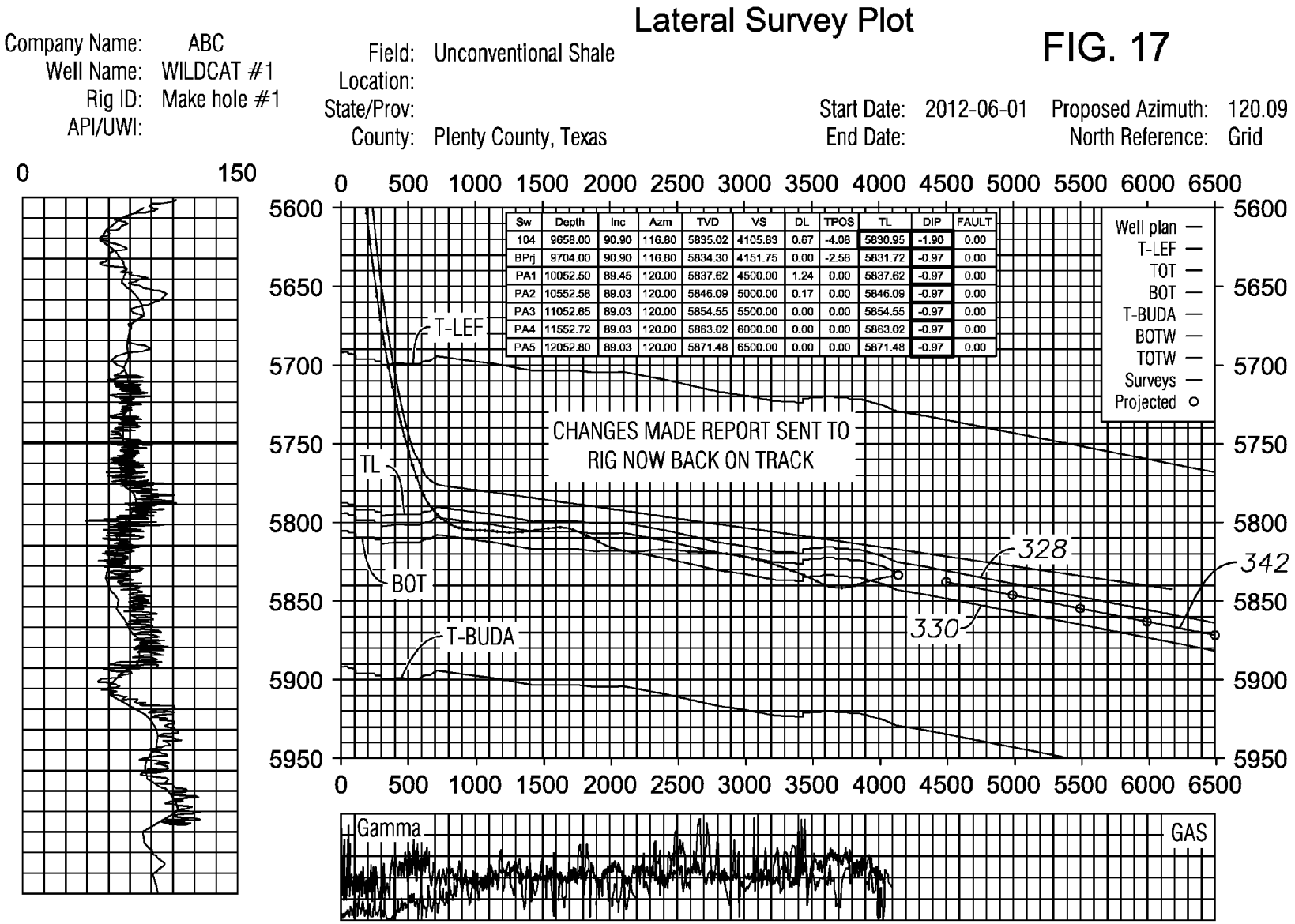
FIG. 17 shows a result of making a change in the drilling orientation of the stratigraphic drilling window using new actual survey data after a deviation flag was transmitted to a drilling rig.

After receiving a target deviation flag, drilling is stopped, an actual survey is performed, the actual survey data is processed, and a new stratigraphic target formation window is generated (Step 54). FIG. 8 depicts actual survey data gathering and processing. FIG. 9 shows the target deviation flag to stop drilling and perform another actual survey. FIG. 10 depicts actual drilling data while drilling gathering and processing. FIG. 17 shows the new stratigraphic target window formation from the actual survey data collected in this step.

Drilling occurs again with the new stratigraphic target formation window while, simultaneously, collecting information from the logging while drilling (LWD) tool at the well surface along with collecting actual drilling data downhole, and while collecting data, calculating with the processor a revised target line that creates a revised top and bottom of the formation, generating a new target window utilizing the ifdip; and then overlaying the new target window over the new stratigraphic target formation window (Step 56).

The steps are repeated until the drill bit reaches a target depth or until the "well is completed" (Step 58).

Figures 4A, 4B:
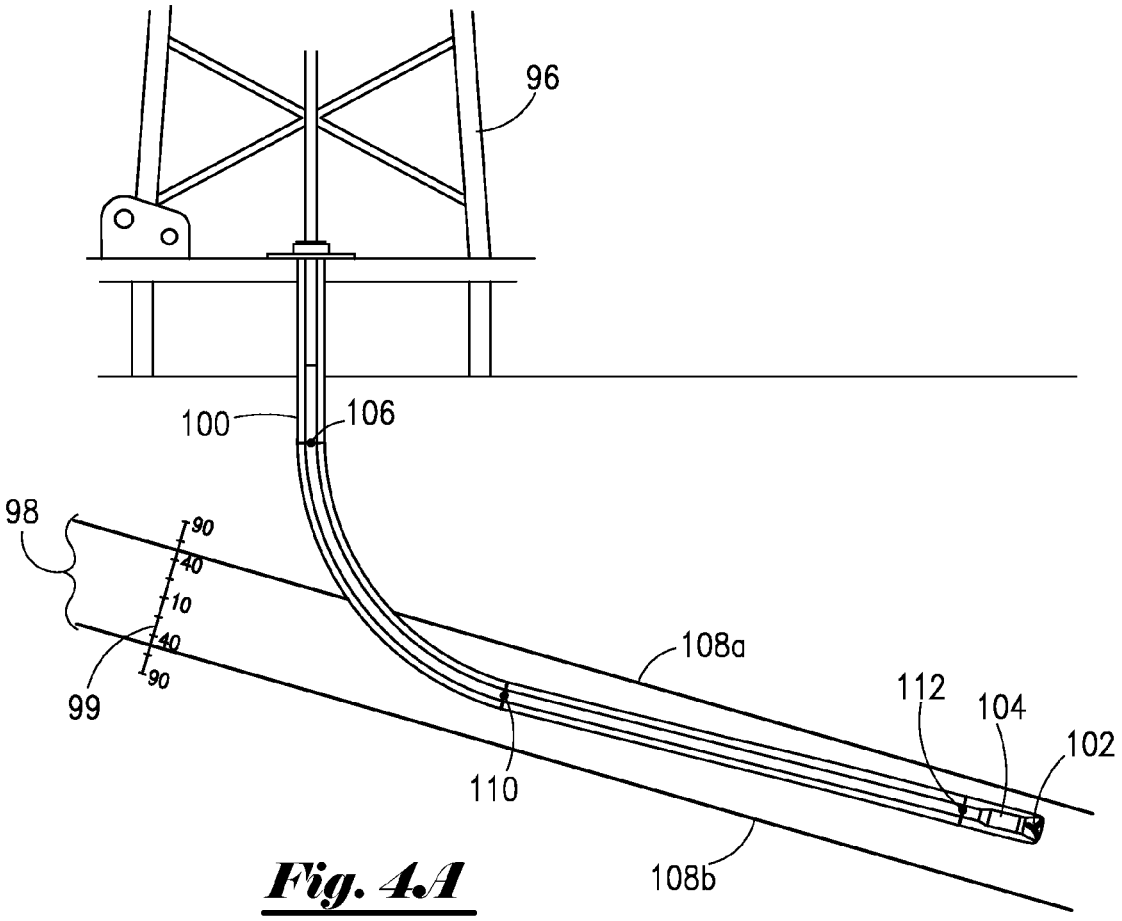
FIG. 4A is a schematic view of a deviated well being drilled from a rig.
FIG. 4B is a chart of gamma ray data obtained from the well seen in FIG. 4A.

Referring now to FIG. 4A, a schematic view of a deviated well being drilled from a rig 96 will now be described. As will be appreciated by those of ordinary skill in the art, a well is drilled into the subterranean zones. The target zone is indicated by the numeral 98, and wherein the target zone 98 has an estimated formation dip angle as set out in step 30 of FIG. 3 (the calculation was previously presented). Returning to FIG. 4A, the offset well log data for zone 98 is shown in numeral 99 for the target zone wherein 99 represents the distribution of gamma counts through the target zone 98 as based on the offset well data.

Figures 6A, 6B:
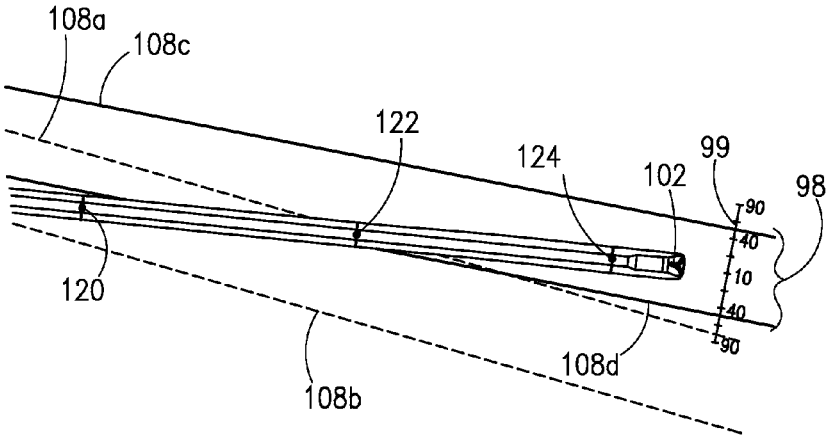
FIG. 6A is the schematic seen in FIG. 5A after further extended drilling.
FIG. 6B is a chart of gamma ray data obtained from the well seen in FIG. 6A.

The well being drilled is denoted by the numeral 100. The operator will drill the well with a drill bit 102 and associated logging means such as a logging while drilling means (seen generally at 104). During the drilling, the operator will continue to correlate the geologic formations being drilled to the offset well drilling and logging data 99 as it relates to the real time drilling and logging data. Once the operator believes that the well 100 is at a position to kick off into the target zone 98, the operator will utilize conventional and known directional techniques to affect the side track, as will be readily understood by those of ordinary skill in the art. A slant well technique, as understood by those of ordinary skill in the art, can also be employed to drill through the target zone, logging it, identify the target zone, plug back and sidetrack to intersect the zone horizontally. As seen at point 106, the operator, based on correlation to known data, kicks off the well 100 utilizing known horizontal drilling techniques. As seen in FIG. 4B, a chart records real time logging data, such as gamma ray counts from the well 100. The charts seen in FIGS. 4B, 5B, and 6B depict three (3) columns: column I shows the true vertical depth (TVD) of the offset well's associated gamma counts previously discussed with reference to numeral 99; column II is the actual well data from well 100 showing true vertical depth (TVD), measured depth (MD), and Gamma Ray (GR); and, column III is the vertical drift distance of the actual well 100 from the surface location.

Hence, at point 106, the well is at a true vertical depth of 1010', a measured depth of 1010' and the gamma ray count is at 100 API units; the depth of the bit relative to the offset well's associated gamma count is 1010'. The estimated formation dip angle is calculated at point 106 by the methods described in FIG. 3, step 30 and in the discussion of FIG. 2. The correlation of the offset well data 99 to the actual logging data verifies that the estimated formation dip angle currently being used accurately positions the drill bit's true stratigraphic position (TSP) in relationship to the target window. Based on this correlation, the estimated formation dip angle can be used as the ifdip to generate the target window to drill ahead. As noted earlier, the ifdip is the instantaneous formation dip angle based on real time logging and drilling data correlation to offset well logging and drilling data as it relates to the TSP of the drill bit.

As noted earlier, the operator kicks off into the target zone 98. As per the teachings of the present embodiments, a top of formation of interest and a bottom of formation of interest has been calculated via the estimated formation dip angle, which in turn defines the window. Moreover, this window is projected outward as seen by projected bed boundaries 108*a*, 108*b*. The logging while drilling (LWD) means 104 continues sending out signals, receiving the signals, and transmitting the received processed data to the surface for further processing and storage as the well 100 is drilled. The top of the formation of interest is intersected and confirms that the estimated formation dip angle used is correct. The operator, based on the LWD information and the formation of interest top intersection can use the current estimated formation dip and project the window to continue drilling, which in effect becomes the instantaneous formation dip angle (ifdip). As noted at point 110, the well is now at a true vertical depth of 1015', a total depth of 1316' and the real time gamma ray count at 10 API units.

The correlation of the offset well data 99 and real time logging data verify that the drill bit's true stratigraphic position (TSP) is within the target window. The ifdip, according to the teachings of the present embodiments, can be changed if necessary to shift the top and bottom window so they reflect the drill bit's TSP within the window. Since the gamma count reading is 10, it correlates to the offset wells 10 gamma count position. Therefore, the actual collected data confirms that the well 100, at point 110, is positioned within the target window when the drill bit's TSP at point 110 was achieved. The instantaneous formation dip angle (ifdip) is calculated at point 110 by the following: inv. tan. [(offset well TVD-real time well TVD)/distance between points]=−0.57 29 degrees, and is used to shift the window in relationship to the drill bit's TSP, and can now be used to project the window ahead so drilling can continue.

As seen in FIG. 4A, the operator continues to drill ahead. The operator actually drills a slightly more up-dip bore hole in the window as seen at point 112. As seen in FIG. 4B, the LWD indicates that the true vertical depth is 1020', the measured depth is 1822' and the gamma ray count is 10 API units, confirming the projected window is correct. The previous instantaneous formation dip angle (ifdip) can continue to be used since the real time logging data at point 112 correlates to the offset log data 99 as it relates to the drill bit's TSP within the target window, and is calculated at point 112 by the following: inv. tan. [(offset well TVD-real time well TVD)/distance between points]=−0.57 29 degrees.

Referring now to FIG. 5A, a schematic representation of the continuation of the extended drilling of well 100 seen in FIG. 4A will now be described with target zone 98. At point 114, the LWD means indicates that the true vertical depth is 1021', the measured depth is 2225' and the real time gamma ray count is 40 API units as shown in Column II of FIG. 5B. The vertical drift distance from the surface location is 1200' as shown in Column III of FIG. 5B. Thus, the correlation between the real time gamma ray count and the offset gamma ray count 99 verifies the drill bit's true stratigraphic position (TSP) is within the target window and the projected window continues to be correct as seen by applying the already established calculation. At point 116, the drill bit has stayed within the projected window, and the chart in FIG. 5B indicates that the true vertical depth is 1023' while the measured depth is 2327' and the gamma ray count is 10; the vertical drift distance from the surface location is 1300'. Hence, as per the correlation procedure previously discussed, the projected window is still correct. The instantaneous formation dip angle is calculated at point 116 by the following: inv. tan. [(offset well TVD-real time well TVD)/distance between points]=−0.57 29 degrees. The same ifdip can be used to project the window ahead to continue drilling.

At point 118 of FIG. 5A, the driller has drilled ahead slightly more down dip. The projected window indicates that the bit should still be within the projected window. However, the chart seen in FIG. 5B indicates that the bit has now exited the projected window by the indication that the gamma ray counts are at 90 API units. Note that the true vertical depth is 1025' and the measured depth is 2530, and the vertical drift distance is 1500'. Therefore, as per the teachings of the present embodiments, creating the projected window requires modification. This is accomplished by changing the instantaneous formation dip angle (ifdip) so that the drill bit's true stratigraphic position (TSP) is located below the bottom of the target window just enough to lineup the real time logging gamma data to the offset well gamma data (99). This is accomplished by decreasing the target formation window's dip angle just enough to line up the correlation stated above. The instantaneous formation dip angle is calculated at point 118 by the following: inv. tan. [(offset well TVD-real time well TVD)/distance between points]=−0.3820 degrees down dip. Based on this new formation dip angle, the top of the formation window is now indicated at 108*c* and the bottom of the formation window is now indicated at 108*d*. FIG. 5A indicates that the dip angle for the target reservoir does in fact change, and a new window with the new instantaneous formation dip angle is projected from this stratigraphic point on and drilling can proceed. The previous window boundaries of 108*a* and 108*b* are also shown.

Referring now to FIG. 6A, the new window has been projected i.e. window boundaries 108*c* and 108*d*. The instantaneous formation dip angle (ifdip), as per the teachings of these embodiments, indicate that the dip angle of the formation of interest has changed to reflect the drill bit's TSP from the correlation of real time logging and drill data to offset data and the target formation window adjusted to the new instantaneous formation dip angle. At point 120, the operator has begun to adjust the bit inclination so that the bit is heading back into the new projected window. As noted earlier, the bottom formation of interest 108*d* and the top formation of interest 108*c* have been revised. FIG. 6B confirms that the bit is now at a true vertical depth of 1024' and a total depth of 2635' at point 120, wherein the gamma ray count is at 65 units. The instantaneous formation dip angle is calculated at point 120 by the following: inv. tan. [(offset well TVD-real time well TVD)/distance between points]=−0.3820 degrees. The correlation procedure mentioned earlier of using the offset well gamma data 99 to compare with real time drilling data indicates that the adjustment made to the bit inclination has indeed placed the drill bit's TSP right below the new target window's bottom, the new target window is 98 in FIG. 6A. This is shown by the real time logging data gamma ray unit of 65 units (see FIG. 6B) lining up with the offset well's gamma ray unit of 65 units (99) below the new target formation window that was created with the previous instantaneous dip angle at point 118.

At point 122, the operator has maneuvered the bit back into the projected window. The real time data found in FIG. 6B confirms that the bit 102 has now reentered the target zone, as well as being within the projected window, wherein the TVD is 1026.5' and the measured depth is 3136' and the gamma ray count is now at 35 API units. The instantaneous formation dip angle (ifdip) used on the projected window is now verified by the correlation procedure mentioned earlier being based on the instantaneous dip formation angle of −0.3820 degrees. The point 124 depicts the bit within the zone of interest according to the teachings of the present embodiments. As seen in FIG. 6B, at point 124, the bit is at a true vertical depth of 1027 and a measured depth of 3337. The gamma ray reads 20 API units therefore confirming that the bit is within the zone of interest. The instantaneous formation dip angle (ifdip) can now be used to project the target window ahead and drilling can continue. The instantaneous formation dip angle is calculated at point 124 by the following: inv. tan. [(offset well TVD-real time well TVD)/distance between points]=−0.3820 degrees. Any form of drilling for oil and gas, utility crossing, in mine drilling and subterranean drilling (conventional, directional or horizontally) can use the embodied methods and techniques to stay within a target zone window.

Figure 7:
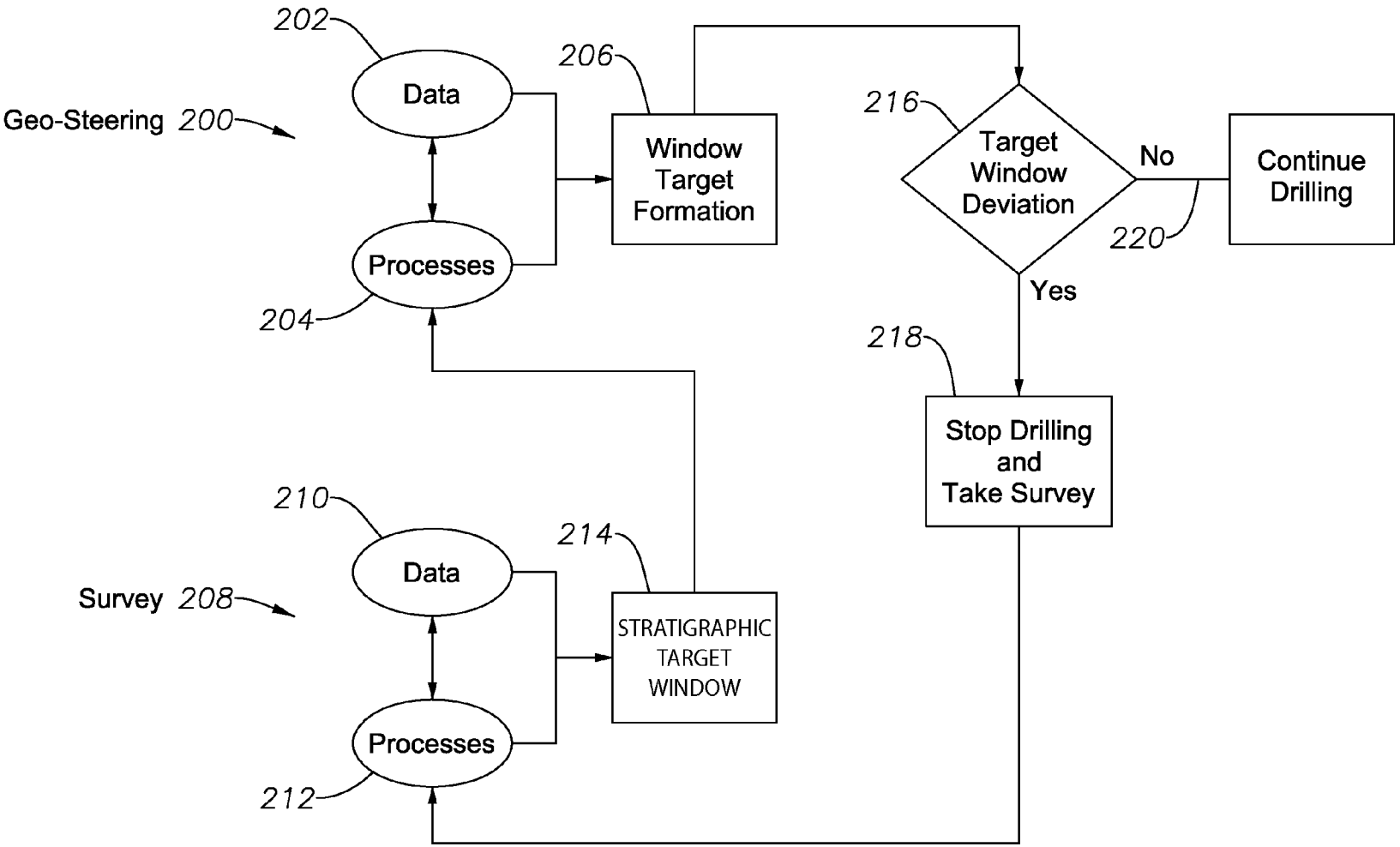
FIG. 7 depicts a systems diagram of one embodiment of the process herein disclosed.

Referring now to FIG. 7, a systems diagram of a second embodiment of the process herein disclosed will be described. The geo-steering technique 200 of this disclosure includes data collection 202 from sources previously mentioned e.g. MWD, EM-MWD, LWD, rig surface equipment monitoring data drilling parameters, seismic, offset wells, etc. The rig surface equipment monitoring data includes, but is not limited to, weight on the drill bit, revolutions per minute of the drill bit, pump rate through the work string and the drill bit, and wherein the rig surface equipment monitoring data is generated by well-known surface equipment typically found on drilling rigs. The data 202 is imported into the geo-steering process 204 in order to model and calculate a stratigraphic position of the wellbore and generate the target formation window 206, as fully disclosed herein. The systems diagram of FIG. 7 also includes the survey technique 208, wherein the survey technique 208 includes the survey data 210, which is gathered along with the geo steering data 202 which includes data from wireline survey instruments, EM-MWD survey instruments, LWD survey instruments, MWD survey instruments, rig surface monitoring equipment data, etc. As depicted in FIG. 7, the processes 212 of the survey technique includes well known processes in the art that are combined with data 210 and data 202 to generate a stratigraphic target formation window 214 using actual survey data. The stratigraphic target formation window 214 is created using actual survey data and is overlaid by the geo steering target window 206 which is provided by the geo-steering process 204, which in turn is used with modeling and calculating the stratigraphic position of the wellbore to send out a target window deviation 216 to modify the stratigraphic target formation window 214 if appropriate.

As per the teachings of this disclosure, in the course of drilling, the output of the target formation window 206 may indicate a target window deviation 216 from the planned stratigraphic well path, which in turn will generate a message (i.e. deviation flag) by the system to stop drilling and collect actual survey data 218. In the event that no deviation from the planned stratigraphic well path within the stratigraphic target formation window 214 is generated ("no change" shown in step 220), then the system allows for continued drilling, monitoring, calculating and modeling. As seen in FIG. 7, if the message is sent regarding a deviation from the planned stratigraphic well path within the stratigraphic target formation window 214, the system directs the message to the survey processes 212 so that survey data 210 can be taken along with geo-steering data 202. In one embodiment, the survey is performed with a wire line tool, EM-MWD, MWD, LWD, etc. This new survey will then generate a new stratigraphic target formation window 214, which in turn will be transmitted to the geo-steering processes 204 to model and calculated by overlaying the geo steering target window 206 continuously generated once drilling commences. This step is accomplished from data sources previously mentioned e.g. MWD, EM-MWD, LWD, rig surface equipment monitoring data drilling parameters, seismic, offset wells, etc. A feature of one embodiment is the integration of prior art survey techniques with geo-steering methods of this disclosure.

Referring now to FIG. 8, a schematic of the survey and geo-steering data flow process will now be described. As understood by those of ordinary skill in the art, a survey is taken on wellbore 224, which extends from a rig 226 (this will be via wireline survey e.g. EM-MWD, MWD, LWD, wireline steering tool, etc.), wherein the survey data and geo-steering data is denoted by the numeral 228. The drill bit 239*a* is seen attached to the workstring 239*b* which is often termed "drill string" in drilling embodiments. The survey data 228 is transmitted to the MWD unit 230 which will be on location at the rig 226. The MWD unit may also be referred to as the MWD dog house 230 where the MWD surface equipment (including electronics) and personal are located at the drilling site. In other words, the MWD unit is on location at the rig 226. The rig surface monitoring equipment for monitoring data drilling parameters is also located at the rig site. The MWD unit will format all the data to a Log ASCII Standard (LAS) file 232 in the embodiment. It should be noted that other file formats, such as WITS and WITSML, could be used. The LAS file 232 will then be transmitted to a remote site. This remote site maybe at the rig or located in a remote office far away from the rig. In one embodiment, the LAS file 232 will be transmitted via microwave transmission, satellite transmission, radio wave transmission, or combinations of these, as transmissions 234 via known means to a command center 236 (also referred to as a remote control unit) that include a processor unit 238 (which is the geo-steering software location). The command center 236 will have contained therein means for modeling and calculating to project the stratigraphic target formation window herein described. The processor unit 238 includes software code instructions loaded onto the processor unit 238 that will evaluate, model and calculate all the data, in accordance with the teachings of this disclosure. Once the stratigraphic target formation window is generated 214, the information will be transmitted to the rig 226 where the generated data can be used to geo-steer and correct the well path to the new stratigraphic target formation window. In addition to the stratigraphic target formation window 214 being transmitted to the rig 226 the system will also have detailed drilling instructions pertaining to drilling distance required and orientation of the downhole drilling equipment to make the well path correction transmitted.

FIG. 9 is a schematic of the one embodiment of the data flow process presented in this disclosure. As seen in FIG. 9, the survey data, geo-steering data and rig surface equipment monitoring data 228, after it's converted to the LAS file 232, is transmitted directly to at least one of: a microwave transmission, a satellite transmission, or radio wave transmission, etc. 234, wherein the data will be received at the command center 236, and wherein the data will be processed by the processor unit 238 as previously mentioned. Once the new stratigraphic target formation window is generated 214, the information will be transmitted directly to the rig 226 where the generated data can be used to geo-steer and correct the well path to the new stratigraphic target formation window transmitted. In addition the stratigraphic target formation window 214 transmitted to the rig 226 will also have detailed drilling instructions pertaining to drilling distance required and orientation of the downhole drilling equipment to make the well path correction. Note that the MWD unit 230 will be bypassed and data from the rig 226 will not pass through the MWD unit. The drill bit 239*a* is shown attached to the workstring 239*b* in the wellbore in this embodiment.

Referring now to FIG. 10, a schematic of another embodiment of the present data flow process will now be described. As seen in FIG. 10, the survey data, geo-steering data and rig surface equipment monitoring data 228 from the rig 226 with the drill bit 239*a* attached to the workstring 239*b* in the wellbore 224 is transmitted real time while drilling is in progress directly to at least one of: a microwave transmission, satellite transmission, or radio wave transmission, shown as transmission 234, wherein the data will be received at the command center 236 and wherein the data will be processed by the processor unit 238 as previously mentioned. Notice that this process by-pass the LAS file creation shown in FIG. 9 (see 232). While drilling ahead, data continues to be transmitted real time directly to microwave transmission, satellite transmission, radio wave transmission, shown as transmission 234, and the data will be received at the command center 236 and wherein the data will be processed by the processor unit 238 as previously mentioned. If it is determined that the real time target formation window 206 shows a deviation from the previous survey data stratigraphic target formation window 214, a deviation flag 218 (i.e. message) is issued and sent by the command center 236 to stop drilling and perform a survey 240 (such as with a EM-MWD, MWD, LWD, wireline steering tool, etc.). Once the new survey information is obtained, the method of modeling, calculating and generating the stratigraphic target formation window depicted in FIG. 7 is initiated again and transmitted as per FIG. 10.

FIG. 11 is a wellbore plot and chart produced as a screen shot according to one embodiment (e.g. embodiment of FIG. 7) of the process herein disclosed using actual survey data. FIG. 12 depicts the plot of the survey and geo-steering data produced with WITS, WITSML or formatted LAS data that is transmitted to the command center. Line 300 represents the past actual position of the wellbore. The chart in FIG. 12 contains columns and rows. The graph to the left (seen generally at 302) depicts the survey data identified by company name, ABC, well name, wildcat #1, Rig ID, make hole #1, API\UWL. The data 303 is previous actual survey data that has been previously modeled, and the line 304 is the offset/control log that the method used to model actual survey data to and the line 306 is the production zones target line (also referred to as "TL") in the offset/control log wellbore. The rows in the chart marked BPrj, PA1-PA5 are data that is projected ahead of the actual survey data using the average DIP data from the previous actual survey data the system has already positioned by using formation dip modeling. BPrj stands for bit projection and PA stands for project ahead. In the chart seen in FIG. 12, the system uses the last actual average formation dips modeled from the past 3, 5, 10 or whatever actual data sets chosen. The average produced is placed in the DIP column starting with BPrj and ending with last PA line and the method automatically generates the depth, inclination, and azimuth needed to produce a TPOS of zero (which is that rows distance (position) from the target line). On the graph in FIG. 11, the first circle 308 is the BPrj location, which is the bit projection station's stratigraphic position, and the stratigraphic position of the next circle 310 is station PA1, circle 312 is PA2, circle 314 is PA3, and circle 316 is PA4. Hence, the chart in FIG. 12 builds a projected stratigraphic target window from the distance away (TPOS) from target line (TL) and creates the top of target 318 and bottom of target 320 and gives the measured depth, inclination and azimuth required to reach that circles TL position on the graph. The TPOS target line position also produces additional upper and lower formations labeled T-LEF 321*a* and T-BUDA 321*b*, respectively. Also, the lower graph plot in FIG. 11 compares and evaluates geo data against the rig surface equipment monitoring data.

FIG. 12 is an exploded view of the wellbore plot and chart seen in FIG. 11 as well as an additional row of data from survey 102 above the column headings. Line 300 is the actual position of the wellbore and circle 308 is the bit projection station which represents the last known actual projected position and inclination of the bit. The following calculations are illustrative of the method disclosed herein (NOTE: "A", "B", and "C" represent rows 1, 2, and 3, respectively, in the chart of FIG. 12):

SVY103: TLB=TAN(DIPB) (−1)*(VSB−VSA)+TLA

TOTB=TAN(−1.2) (−1)*(4009.98−3915.10)+5825.78

SVY103: TLB=5827.77 [0074] SVY103: TPOS=TLB−TVDB

TPOS=5827.77−5836.11=−8.34

BPrj: TLC=TAN(DIPC) (−1)*(VSC−VSB)+TLB

TOTC=TAN(−0.53)(−1)*(4055.92−4009.98)+5827.77

BPrj: TLC=5828.19

BPrj: TPOS=TLC−TVDC

BPrj: TPOS=5828.19−5835.79=−7.6

The rest of the chart for the PA stations uses the same calculations once you set the dip value.

A fault value if positive is a shift data up and adds TVD to the TL. A fault value if negative is a shift data down and subtracts TVD from the TL.

Hence, once the data set is modeled with a dip, that dip appears in the dip column of the survey row 103 and it is used to calculate where the target line (TL) true vertical depth (TVD) is located at that rows vertical section (VS) distance. Thus, the dip calculates how far the TL has moved from row to row and uses the TL TVD to subtract from the survey row or PA row TVD to determine how far away (TPOS) the actual or projected wellbore is from the TL assuming the DIP columns value. Each line uses the same line by line calculation to achieve the target line TVD and TPOS the wellbore is from each line's TVD. The graph plots the TVD (y-axis) of the actual survey 103 (which is line 300), the BPrj circle 308 and its respective vertical section (VS) column (x-axis). The project ahead circle stations plot the same according to the target line TVD on the y-axis and vertical section (VS) column (x-axis).

FIG. 13 is a sequential view of the wellbore plot seen in FIG. 11 according to the present method and is understood while additionally viewing FIG. 14. The target line which creates the target window top 322 and the target window bottom 324 (thereby forming the target window) is built just like the chart above with the real time data while drilling. The graph to the left shows a piece of streamed data 325 that was modeled with a −0.40 degree DIP (shown above in the chart in the survey row 104 in DIP column in FIG. 14). By plotting target line 340, real time data (i.e. top 322 and bottom 324) are created, the operator can check to see how well target line 340 correlates to what was modeled from the actual survey data transmitted via LAS file format or any other format (WITS, WITSML, etc.). Hence, it appears that the −0.53 calculated average DIP (from previous modeled actual survey data) in the project ahead stations correlates well to the −0.40 degree DIP from the actual drilling data while drilling modeled on the projected top 322 and bottom 324. Thus, no immediate change or target deviation flag is needed from the geo steering to the directional driller and drilling can proceed. FIG. 14 is a chart providing real time data used in the generation of the TL to create the top 322 and bottom 324 targets seen in FIG. 13.

FIG. 15A is a sequential view of the wellbore plot seen in FIG. 13 which is best understood taken with FIG. 16. As more actual drilling data while drilling is streamed in real time as drilling continues, the operator will note that circumstances have changed as compared to the plot of FIG. 13. The real time actual drilling data while drilling to the left (line 326) is modeled from the survey row 104 DIP of −1.9 degree and the produced target line 340 that creates the window top 328 and bottom 330 reflects this projection. As seen in FIG. 15B, the target window is dipping down more than the actual survey data average previous stratigraphic target formation window modeled at −0.53 DIP (lines 332, 334). Thus, a deviation flag is generated and a message is transmitted to the rig to stop drilling and take an actual survey data with geo-steering data, which can be a wireline survey tool, EM-MWD, MWD, LWD, etc. In this way, the command center can receive the actual survey and geo-steering data (in the LAS data format, WITS or WITSML, for instance) to model and then transmit an updated stratigraphic target formation window. The upper chart BPrj and PA stations in FIG. 15A are the actual survey data from the previous survey. The project ahead stations on the upper chart plot the target line which creates the plot of the top of target 332 and the bottom of target 334 window on the graph. The current real time actual drilling data while drilling is modeling to show a −1.9 degree down dip which is on the chart at the survey row 104, column DIP. FIG. 16 is a chart providing real time data used in the generation of the TL that creates the top 328 and bottom 330 targets seen in FIG. 15A along with the PA station circle TPOS locations. The chart is the real time data chart which is represented by the graph of the top 328 and the bottom 330. The method averages the last 500' of DIP values already modeled including the −1.9 degree dip and came up with a possible average formation DIP ahead of −0.97 down dip. Hence, while it was initially modeled that the dip average would be −0.53 down dip, but since the −0.53 down dip is not matching in real time, the method generates a flag regarding the deviation and a message is sent to stop drilling and take an actual survey data and geo data shot, along with rig surface equipment monitoring data and make changes.

FIG. 17 is a lateral survey plot of a wellbore. This plot shows changes made to the drill bit path showing the rig is now back on track. In addition, the new PA stations along track 342 show how far to drill and at what orientation to achieve the new well path generated from the above process. The top of the new window 328 and bottom of the new window 330 are shown. This window expedites well path corrections and keeps the well path on course. In addition, it will allow the drilling team to better manage their slide drilling time for corrections versus their rotate drilling time for maintaining wellbore course. By optimizing the rotary drilling time versus the slide drilling time wells can be drilled faster and smoother than they are conventionally drilled yielding cost savings.

As per the teachings of the present embodiments, the operators can utilize a remote personal tablet to receive and send survey and log data anywhere around the location via a wireless remote router. Hence, reception and transmission is possible from the mud logger shack, the dog house or from the edge of the location. The command center can stream multiple wells at one time, process the data and generate models as set out herein. In addition, the wells can be monitored remotely with personal tablets, smart phones and laptops that are commercially available from manufactures such as Apple, Inc., Microsoft Inc., Verizon Inc., etc.

Figure 18:
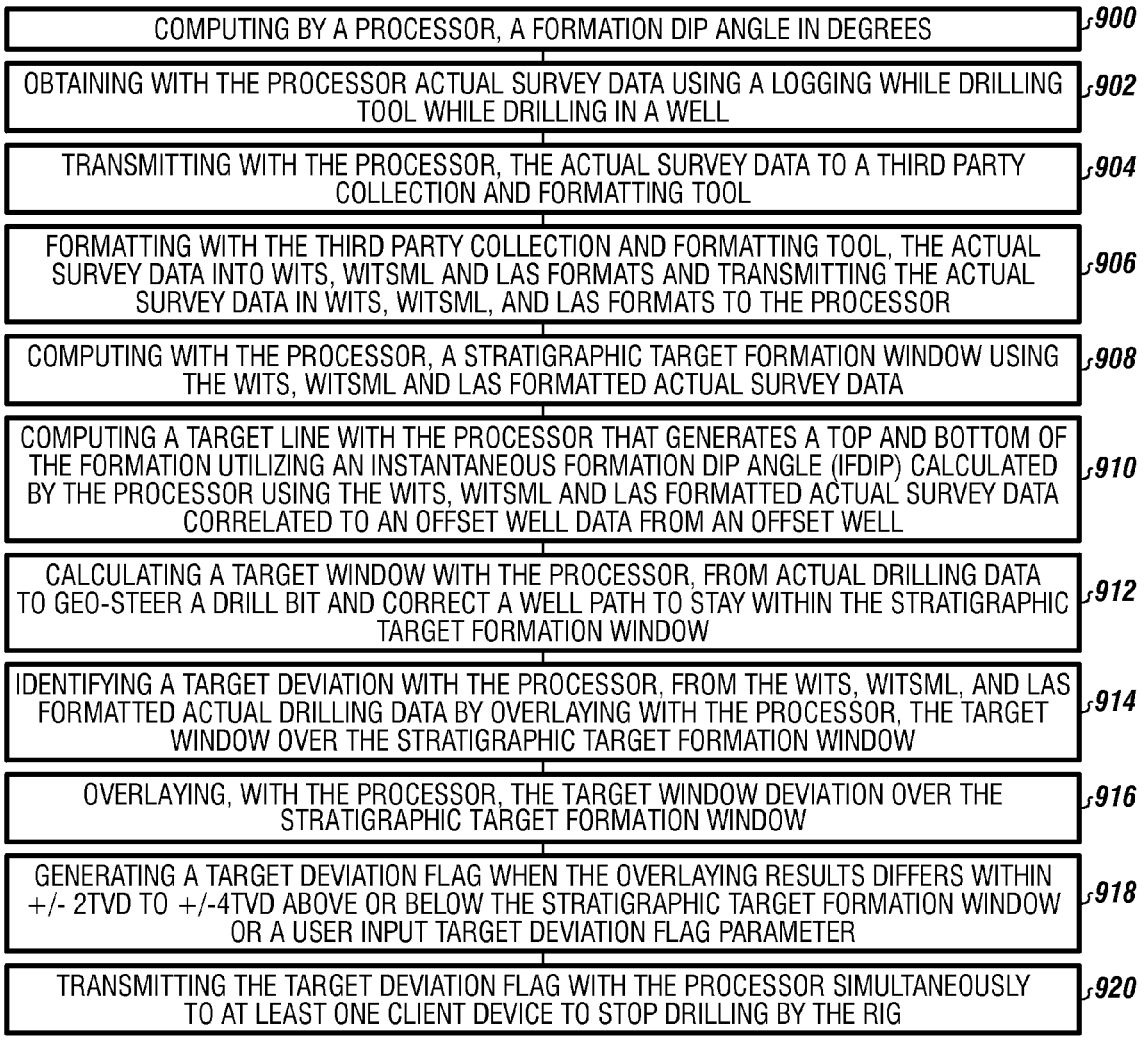
FIG. 18 is a diagram of steps of an embodiment of the computer implemented method described herein.

FIG. 18 shows the sequence of steps for the computer implemented method for drilling a formation penetrated by multiple wells, a drill bit moves through the formation, by computing by a processor, a formation dip angle in degrees (Step 900) obtaining with the processor actual survey data using a logging while drilling tool while drilling in a well (Step 902); transmitting with the processor, the actual survey data to a third party collection and formatting tool (Step 904); formatting with the third party collection and formatting tool, the actual survey data into WITS, WITSML and LAS formats and transmitting the actual survey data in WITS, WITSML, and LAS formats to the processor (Step 906); computing with the processor, a stratigraphic target formation window using the WITS, WITSML and LAS formatted actual survey data (Step 908), computing a target line with the processor that generates a top and bottom of the formation utilizing an instantaneous formation dip angle (ifdip) calculated by the processor using the WITS, WITSML and LAS formatted actual survey data correlated to an offset well data from an offset well (Step 910); calculating a target window with the processor, from actual drilling data to geo-steer a drill bit and correct a well path to stay within the stratigraphic target formation window (Step 912); identifying a target window deviation with the processor, from the WITS, WITSML, and LAS formatted actual drilling data (Step 914); overlaying, with the processor, the target window deviation over the stratigraphic target formation window (Step 916); generating a target window deviation flag when the overlaying results in a target deviation window that differs within +/−2TVD to +/−4TVD above or below the target window or a user input target window deviation flag parameter (Step 918); and transmitting the target window deviation flag with the processor simultaneously to at least one client device (Step 920).

In embodiments, the method contemplates drilling the well with the logging while drilling (LWD) tool and obtaining actual survey data representative of the characteristics of the reservoir; collecting information from the logging while drilling (LWD) tool at the well surface; transmitting collected information to a remote control unit; calculating a revised target line that creates a top and bottom of the formation utilizing the ifdip; projecting a second target window for drilling the well.

In embodiments, the method involves projecting a second target window deviation; over the stratigraphic target formation window, and when the overlaying results in a second target deviation window that differs within +/−2TVD to +/−4TVD above or below the first target window deviation or a user input target window deviation flag parameter with a recommendation to ceasing the drilling and perform another actual well survey, to generate actual survey data and use the generated data to create target windows and compute target window deviations.

In embodiments, the offset well data includes data from electric line logs.

In embodiments, the actual survey data from the logging while drilling (LWD) tool includes a resistivity log.

In embodiments, the method contemplates drilling the well or completing the well for production.

In embodiments, the logging while drilling tool data analyzed by the processor including weight on the drill bit, revolutions per minute of the drill bit, downhole annulus pressure, gas, differential pressure, pump rate, rate of penetration and other drill site data acquired during actual survey data or actual drilling data collection through WITS, WITSML, and LAS.

Although the present embodiments have been described in considerable detail with reference to certain versions thereof, other versions are possible. Therefore, the spirit and scope of the appended claims should not be limited to the description of the versions contained herein.

Although the present embodiments have been described in terms of certain embodiments, it will become apparent that modifications and improvements can be made to the inventive concepts herein without departing from the scope of the invention. The embodiments shown herein are merely illustrative of the inventive concepts and should not be interpreted as limiting the scope. The term "stratigraphic" can be used interchangeably with "stratagraphic", "strata graphic", and "strata-graphic".

While these embodiments have been described with emphasis on the embodiments, it should be understood that within the scope of the appended claims, the embodiments might be practiced other than as specifically described herein.

What is claimed is:

1. A method for drilling a formation penetrated by multiple wells, the method comprising:

a. computing by a processor, a formation dip angle in degrees;

b. obtaining with the processor actual survey data using a logging while drilling tool while drilling in a well;

c. transmitting with the processor the actual survey data to a third party collection and formatting tool;

d. formatting with the third party collection and formatting tool the actual survey data into WITS, WITSML and LAS formats and transmitting the actual survey data in WITS, WITSML, and LAS formats to the processor;

e. computing with the processor a stratigraphic target formation window using the WITS, WITSML and LAS formatted actual survey data;

f. computing a target line with the processor that generates a top and a bottom of the formation utilizing an instantaneous formation dip angle (ifdip) calculated by the processor using the WITS, WITSML and LAS formatted actual survey data correlated to offset well data from an offset well;

g. calculating a target window with the processor from actual drilling data to geo-steer a drill bit and correct a well path to stay within the stratigraphic target formation window;

h. identifying a target deviation with the processor from the WITS, WITSML, and LAS formatted actual drilling data by overlaying with the processor the target window over the stratigraphic target formation window;

i. generating a target deviation flag when the overlaying results differs within +/−2TVD to +/−4TVD above or below the stratigraphic target formation window or a user inputted target deviation flag parameter; and j. transmitting a target deviation flag with the processor simultaneously to at least one client device to stop drilling by a rig.

2. The method of claim 1, further comprising after receiving the target deviation flag, drilling the well with the logging while drilling (LWD) tool and obtaining additional actual survey data representative of the characteristics of the reservoir; collecting information from the logging while drilling (LWD) tool at the well surface; transmitting collected information to a remote control unit; calculating a revised target line that creates a top and bottom of the formation utilizing the ifdip; and calculating a second stratigraphic target formation window for drilling the well.

3. The method of claim 2, further comprising: collecting additional actual drilling data calculating a second target window with the processor, overlaying the second target window over the stratigraphic target formation window using the processor to perform directed geo-steering, and when the overlaying results differs within +/−2TVD to +/−4TVD above or below the stratigraphic target formation window or the user inputted target deviation flag parameter; transmitting the target deviation flag with the processor simultaneously to the at least one client device to stop drilling by the rig.

4. The method of claim 3, wherein the offset well data includes data from electric line logs.

5. The method of claim 4, wherein the actual survey data includes data from the logging while drilling (LWD) tool including a resistivity log.

6. The method of claim 2, further comprising completing the well for production.

7. The method of claim 1, with the logging while drilling tool data analyzed by the processor including data for weight on the drill bit, revolutions per minute of the drill bit, downhole annulus pressure, gas, differential pressure, pump rate, rate of penetration and other drill site data acquired during collection of actual survey data or during collection of actual drilling data collection through the WITS, WITSML, and LAS formatted actual drilling data.

* * * * *